US005477826A

United States Patent [19]

Hara et al.

[11] Patent Number: 5,477,826

[45] Date of Patent: Dec. 26, 1995

[54] THROTTLE CONTROL APPARATUS FOR INTERNAL COMBUSTION ENGINE

[75] Inventors: Mitsuo Hara, Aichi; Shigeru Kamio, Nagoya; Hitoshi Tasaka, Chiryu; Masashi Kiyono, Anjo, all of Japan

[73] Assignee: Nippondenso Co., Ltd., Kariya, Japan

[21] Appl. No.: 376,081

[22] Filed: Jan. 20, 1995

Related U.S. Application Data

[62] Division of Ser. No. 65,799, May 24, 1993, abandoned.

[30] Foreign Application Priority Data

May 25, 1992 [JP] Japan ..... 4-132886
Sep. 10, 1992 [JP] Japan ..... 4-242050

[51] Int. Cl.[6] ..... F02M 3/00

[52] U.S. Cl. ..... 123/339.16; 123/399

[58] Field of Search ..... 123/399, 339.16, 123/339.17, 339.18, 361

[56] References Cited

U.S. PATENT DOCUMENTS

| | | | |
|---|---|---|---|
| 4,705,001 | 11/1987 | Danno et al. | 123/339 |
| 4,799,467 | 1/1989 | Ishikawa et al. | 123/399 |
| 4,941,444 | 7/1990 | Fujita | 123/399 |
| 5,078,109 | 1/1992 | Yoshida et al. | 123/399 |

FOREIGN PATENT DOCUMENTS

| | | |
|---|---|---|
| 4126300 | 2/1992 | Germany . |
| 58-10131 | 1/1983 | Japan . |
| 58-122326 | 7/1983 | Japan . |
| 59-224422 | 12/1984 | Japan . |
| 63-180755 | 7/1988 | Japan . |
| 3107561 | 5/1991 | Japan . |

*Primary Examiner*—Noah P. Kamen
*Attorney, Agent, or Firm*—Cushman, Darby & Cushman

[57] ABSTRACT

A throttle control apparatus serves to control a degree of opening of a throttle valve via an actuator. The throttle valve is provided in an air induction passage of an internal combustion engine. The throttle control apparatus includes a throttle opening degree sensor for detecting the degree of opening of the throttle valve. An engine operating condition detecting device is operative to detect an operating condition of the engine. A throttle opening degree estimating device is operative to estimate the degree of opening of the throttle valve on the basis of the operating condition of the engine which is detected by the engine operating condition detecting device. A memorizing means serves to memorize a corrective quantity. A corrective quantity updating device is operative to update the corrective quantity memorized by the memorizing device on the basis of a difference between an output value from the throttle opening degree sensor and an estimated value from the throttle opening degree estimating device. A control device serves to adjust a controlled quantity of the actuator in response to the output value from the throttle opening degree sensor and the corrective quantity memorized by the memorizing device to control the degree of opening of the throttle valve.

11 Claims, 18 Drawing Sheets

THROTTLE CONTROL APPARATUS FOR INTERNAL COMBUSTION ENGINE

This is a division of application Ser. No. 8/065,799, filed on May 24, 1993, which was abandoned upon the filing hereof.

BACKGROUND OF THE INVENTION

1. Field of the Invention

This invention generally relates to a throttle control apparatus for an internal combustion engine. This invention specifically relates to an apparatus including a sensor for detecting the degree of opening of a throttle valve in an internal combustion engine, and a device for feedback-controlling the actual degree of opening of the throttle valve at a target degree in response to the detected degree of opening of the throttle valve.

2. Description of the Prior Art

In recent years, most automotive internal combustion engines have been equipped with a sensor for detecting the degree of opening of a throttle valve. The output signal of the throttle opening degree sensor (throttle position sensor) is used by various types of control.

A known throttle control apparatus includes a DC motor for moving a throttle valve, a sensor for detecting the degree of opening of the throttle valve, and a device for driving the DC motor in response to the detected degree of opening of the throttle valve to control the actual degree of opening of the throttle valve.

In some automotive vehicles with automatic transmissions, a sensor detects the degree of opening of a throttle valve, and the automatic transmission is controlled in response to the detected degree of opening of the throttle valve according to a predetermined transmission control map.

The characteristics of throttle opening degree sensors (throttle position sensors) tend to vary from sensor to sensor. In addition, the characteristics of throttle opening degree sensors tend to vary with ageing thereof. Such variations in the sensor characteristics cause errors in the sensor output signal.

As will be described hereinafter, there are various known apparatus for correcting an error in the output signal of a throttle opening degree sensor.

Japanese published unexamined patent application 58-10131 and Japanese published unexamined patent application 63-180755 disclose throttle control apparatus in which a switch serves to detect the fully-closed position of a throttle valve, and the output signal of a throttle opening degree sensor which occurs when the switch is turned on is used as an indication of the fully-closed position of the throttle valve to correct an error in the sensor output signal.

Japanese published unexamined patent application 58-122326 and Japanese published unexamined patent application 3-107561 disclose throttle control apparatus in which the detected value currently prodded by a throttle opening degree sensor is compared with a memorized idle value (fully-closed position value). When the current detected value is smaller than the memorized idle value, the current detected value is memorized as a new idle value so that the memorized idle value is updated. Otherwise, the memorized idle value is held as it is. The updating of the memorized idle value corrects an error in the sensor output signal.

In the throttle control apparatus of Japanese patent application 58-122326, a determination is made as to whether the detected value provided by the throttle opening degree sensor equals a same value a given number of times or for a given length of time. In cases where the detected value provided by the throttle opening degree sensor equals a same value the given number of times or for the given length of time, when the same value is smaller than the memorized idle value, the current detected value is memorized as a new idle value so that the memorized idle value is updated.

In the throttle control apparatus of Japanese patent application 3-107561, engine operating conditions corresponding to the throttle fully-closed position can be detected by a suitable device. In cases where such engine operating conditions are actually detected, when the memorized idle value is smaller than the detected value currently provided by the throttle opening degree sensor, the memorized idle value is corrected into an increased idle value. The correction of the memorized idle value is intended to prevent am adverse affection of noise components of the sensor output signal.

The above-mentioned known throttle control apparatus have problems as follows. Generally, operating conditions of engines (for example, the rates of air flow into the engines) which occur at the fully-closed position of a throttle valve vary from engine to engine. Specifically, air leaks through throttle valves of engines even when the throttle valves are fully closed, and the rates of air leakage vary from engine to engine. Therefore, the relations between the throttle opening degrees detected by throttle position sensors and the engine operating conditions vary from engine to engine. Such a variation in the relations causes another type of error in the sensor output signal which adversely affects control responsive to the sensor output signal and the engine operating conditions. The above-mentioned known throttle control apparatus can not correct this type of error in the sensor output signal. In addition, the relation between the throttle opening degree detected by the throttle position sensor and the engine operating conditions varies with ageing of the sensor and a change in the engine operating conditions. Such a variation in the relation causes a type of error in the sensor output signal which adversely affects control responsive to the sensor output signal and the engine operating conditions. The above-mentioned known throttle control apparatus can not correct this type of error in the sensor output signal.

SUMMARY OF THE INVENTION

It is an object of this invention to provide an improved throttle control apparatus for an internal combustion engine.

A first aspect of this invention provides a throttle control apparatus for controlling a degree of opening of a throttle valve via an actuator, the throttle valve being provided in an air induction passage of an internal combustion engine, the apparatus comprising a throttle opening degree sensor for detecting the degree of opening of the throttle valve; engine operating condition detecting means for detecting an operating condition of the engine; throttle opening degree estimating means for estimating the degree of opening of the throttle valve on the basis of the operating condition of the engine which is detected by the engine operating condition detecting means; memorizing means for memorizing a corrective quantity; corrective quantity updating means for updating the corrective quantity memorized by the memorizing means on the basis of a difference between an output value from the throttle opening degree sensor and an estimated value from the throttle opening degree estimating means; and control means for adjusting a controlled quantity of the actuator in response to the output value from the throttle opening degree sensor and the corrective quantity memorized by the memorizing means to control the degree of opening of the throttle valve.

A second aspect of this invention provides an apparatus for setting a reference degree of opening of a throttle valve provided in an air induction passage of an internal combustion engine, the apparatus comprising a throttle opening degree sensor for detecting the degree of opening of the throttle valve; engine operating condition detecting means for detecting an operating condition of the engine; throttle opening degree estimating means for estimating the degree of opening of the throttle valve on the basis of the operating condition of the engine which is detected by the engine operating condition detecting means; memorizing means for memorizing a corrective quantity; corrective quantity updating means for updating the corrective quantity memorized by the memorizing means on the basis of a difference between an output value from the throttle opening degree sensor and an estimated value from the throttle opening degree estimating means; and correcting means for correcting the reference degree of opening of the throttle valve in accordance with the corrective quantity memorized by the memorizing means.

A third aspect of this invention provides a throttle control apparatus for controlling a degree of opening of a throttle valve via an actuator, the throttle valve being provided in an air induction passage of an internal combustion engine, the apparatus comprising a throttle opening degree sensor for detecting the degree of opening of the throttle valve; corrective quantity learning means for detecting a corrective quantity for an output value from the throttle opening degree sensor on the basis of the output value from the throttle opening degree sensor and/or predetermined parameters related to operating conditions of the engine, and for updating and memorizing the corrective quantity; ISC means for adjusting a controlled quantity of the actuator in response to the output value from the throttle opening degree sensor, the corrective quantity updated by the corrective quantity learning means, and an ISC learned value to adjust the degree of opening of the throttle valve, and for calculating a feedback control quantity to make a speed of the engine equal to a target speed and further adjusting the controlled quantity of the actuator in response to the calculated feedback control quantity to adjust the degree of opening of the throttle valve. Allowing means for allowing an ISC learning process when the corrective quantity is updated by the corrective quantity learning means; and ISC learning means for executing a process of learning the ISC learned value on the basis of the feedback control quantity calculated by the ISC means when the allowing means allows the ISC learning process.

A fourth aspect of this invention provides an apparatus for a movable throttle valve in an engine which comprises first means for detecting an actual position of the throttle valve and generating a throttle position signal representative thereof; second means for detecting an operating condition of the engine; third means for estimating an effective position of the throttle valve in response to the engine operating condition detected by the second means; and fourth means for correcting the throttle position signal in accordance with the effective throttle valve position estimated by the third means.

DESCRIPTION OF THE FIRST PREFERRED EMBODIMENT

Figure 1:
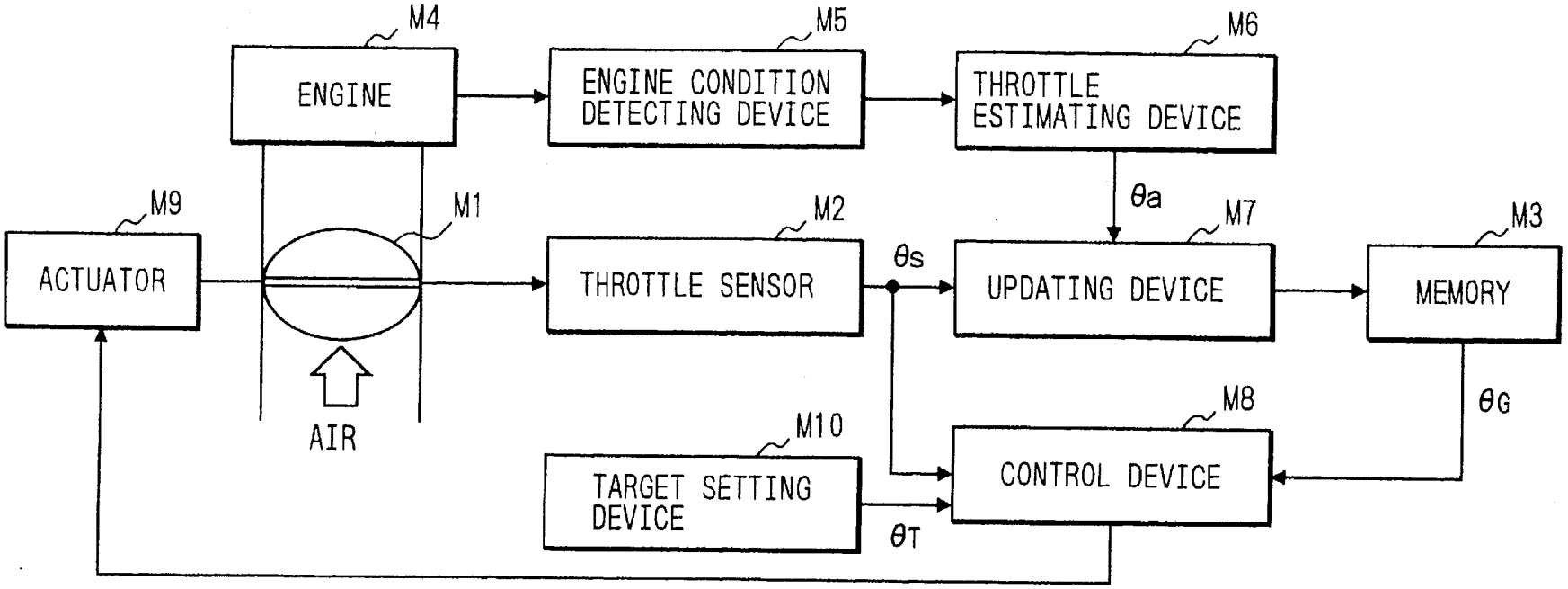
FIG. 1 is a diagram of a throttle control apparatus according to a first embodiment of this invention.

With reference to FIG. 1, a movable throttle valve M1 is disposed in an air induction passage leading to a main body of an internal combustion engine M4. The degree of opening of the throttle valve M1, that is, the position of the throttle valve M1, is detected by a sensor M2. The throttle opening degree sensor (throttle position sensor) M2 outputs a signal corresponding to a value or quantity θs which represents the detected degree of opening of the throttle valve M1. A memory M3 stores a corrective quantity (corrective value) θG for the output value θs from the throttle opening degree sensor M2.

An operating condition of the engine M4 is detected by a device M5. A device M6 connected to the detecting device M5 estimates the effective degree of opening of the throttle valve M1 on the basis of the operation condition of the engine M4 which is detected by the detecting device M5. The estimating device M6 outputs a signal representing an estimated value or quantity θa of the effective degree of opening of the throttle valve M1.

A device M7 connected among the throttle opening degree sensor M2, the estimating device M6, and the memory M3 updates the corrective quantity θG in the memory M3 in response to a difference between the output value θs from the throttle opening degree sensor M2 and the output estimated value θa from the estimating device M6.

The throttle valve M1 can be driven by an actuator M9. A control device M8 connected among the throttle opening degree sensor M2, the memory M3, and the actuator M9 controls the actuator M9 in response to the output value θs from the throttle opening degree sensor M2 and the corrective quantity θG from the memory M3. Specifically, the control device M8 determines a controlled quantity of the actuator M9 in response to the value θs and the corrective quantity θG. Thus, the control device M8 adjusts the actual degree of opening of the throttle valve M1 in response to the value θs and the corrective quantity θG.

It is preferable that the updating device M7 executes updating of the corrective quantity θG when the operating condition of the engine is steady.

The detecting device M5 may be a device for detecting the rate of air flow into the engine M4. The detecting device M5 may also be a device for detecting the rotational speed of the engine M4. The detecting device M5 may include both a device for detecting the rotational speed of the engine M4 and a device for detecting the pressure in the air induction passage downstream of the throttle valve M1.

A setting device M10 may inform the control device M8 of a target throttle opening degree θT for automotive traction control or automotive cruise control, and the control device M8 may be designed to respond to the target throttle opening degree θT. Specifically, in this case, the output value θs from the throttle opening degree sensor M2 or the target throttle opening degree θT is corrected in accordance with the corrective quantity θG, and the actuator M9 is feedback-controlled in response to the value θs, the corrective quantity θG, and the target throttle opening degree θT.

As previously described, the relations between the throttle opening degrees detected by throttle position sensors and the engine operating conditions vary from engine to engine. Such a variation in the relations causes a type of error in the sensor output signal which adversely affects control responsive to the sensor output signal and tile engine operating conditions. In addition, the relation between the throttle opening degree detected by a throttle position sensor and the engine operating conditions varies with ageing of the sensor and a change in the engine operating conditions. Such a variation in the relation causes a similar type of error in the sensor output signal which adversely affects control responsive to the sensor output signal and the engine operating conditions. These errors in the sensor output signal are removed by the previously-mentioned correcting process responsive to the corrective quantity θG, so that control responsive to the output value θs from the throttle opening degree sensor M2 such as automotive traction control or automotive cruise control can be accurate and reliable.

DESCRIPTION OF THE SECOND PREFERRED EMBODIMENT

Figure 2:
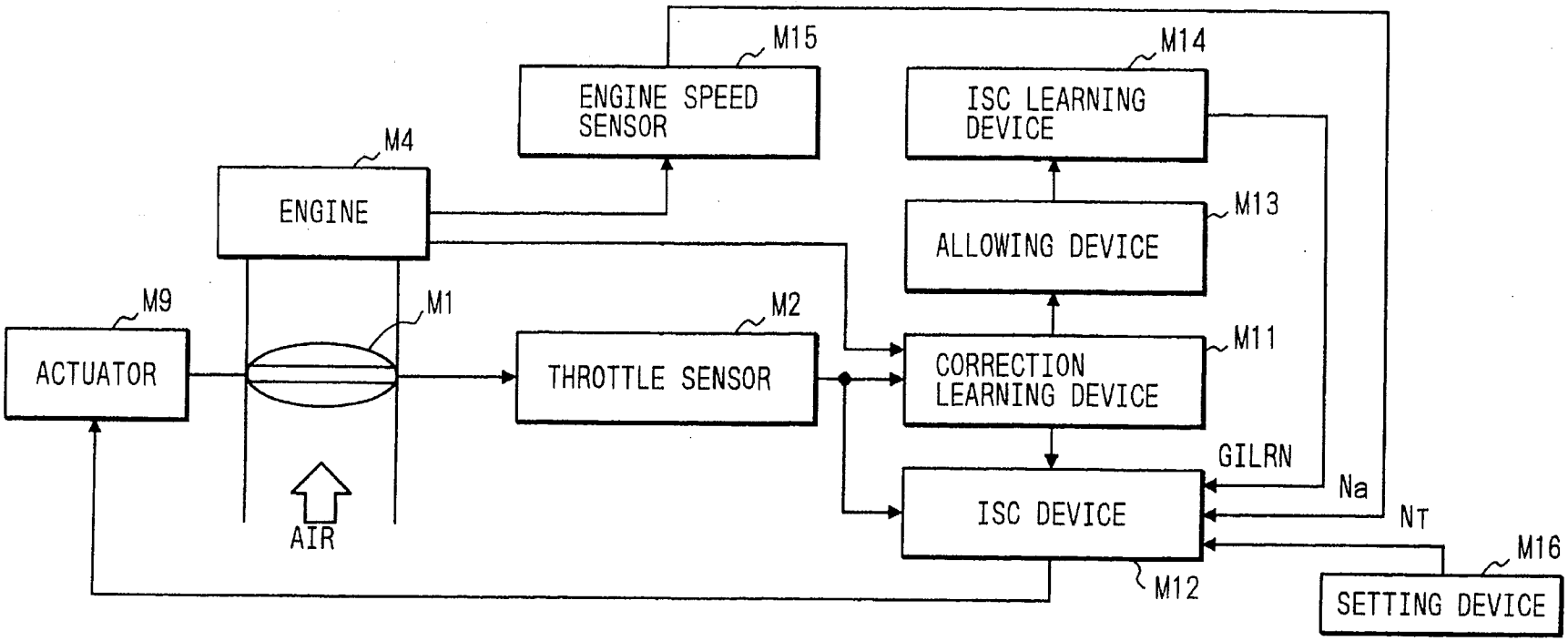
FIG. 2 is a diagram of a throttle control apparatus according to a second embodiment of this invention.

With reference to FIG. 2, a movable throttle valve M1 is disposed in an air induction passage leading to a main body of an internal combustion engine M4. The degree of opening of the throttle valve M1, that is, the position of the throttle valve M1, is detected by a sensor M2. The throttle opening degree sensor (throttle position sensor) M2 outputs a signal corresponding to a value or quantity θs which represents the detected degree of opening of the throttle valve M1.

A device M11 connected to the throttle opening degree sensor M2 is informed of the output value θs therefrom. In addition, the device M11 is informed of operating conditions of the engine M4. The device M11 executes a learning process which is designed so that a corrective quantity or value θG for the output value θs from the throttle opening degree sensor M2 can be determined in accordance with the value θs and/or various parameters related to the operating conditions of the engine M4. The learning device M11 suitably updates the corrective quantity θG and memorizes the updated corrective quantity θG.

The throttle valve M1 can be driven by an actuator M9. An ISC (idle speed control) device M12 connected to the throttle opening degree sensor M2 and the learning device M11 is informed of the output value θs and the corrective quantity θG therefrom. In addition, the ISC device M12 is informed of an ISC learned value GILRN, the actual rotational speed Na of the engine M4, and a target rotational speed NT of the engine M4. The ISC device M12 is connected to the actuator M9. The ISC device M12 adjusts a controlled quantity of the actuator M9 and thereby controls the degree of opening of the throttle valve M1 in response to the output value θs of the throttle opening degree sensor M2, the corrective quantity θG updated by the learning device M11, and the ISC learned value GILRN. In addition, the ISC device M12 calculates a feedback control quantity designed to make the actual engine speed Na equal to the target engine speed NT. The ISC device M12 also adjusts the controlled quantity of the actuator M9 and thereby controls the degree of opening of the throttle valve M1 in response to the calculated feedback control quantity.

A device M13 connected to the learning device M11 allows an ISC learning process when the corrective quantity θG is updated by the learning device M11. When the allowing device M13 allows the ISC learning process, a device M14 connected to the allowing device M13 and the ISC device M12 executes a process of learning the ISC leaned value GILRN on the basis of the feedback control quantity calculated by the ISC device M12.

It is preferable that the actual engine speed Na is detected by an engine speed sensor M15, and the target engine speed NT is set by a setting device M16.

In this embodiment, when the corrective quantity θG is updated by the learning device M11, the allowing device M13 allows the ISC learning process. The allowance of the ISC learning process enables the execution of the ISC learning process by the learning device M14. Thus, the execution of the ISC learning process is started after the updating of the corrective quantity θG is completed. Accordingly, the ISC learning process is executed under idle speed control (ISC) in which an error in the output signal of the throttle opening degree sensor M2 is corrected. The error correction ensures that the ISC leaned value GILRN is accurate and reliable.

DESCRIPTION OF THE THIRD PREFERRED EMBODIMENT

Figure 3:
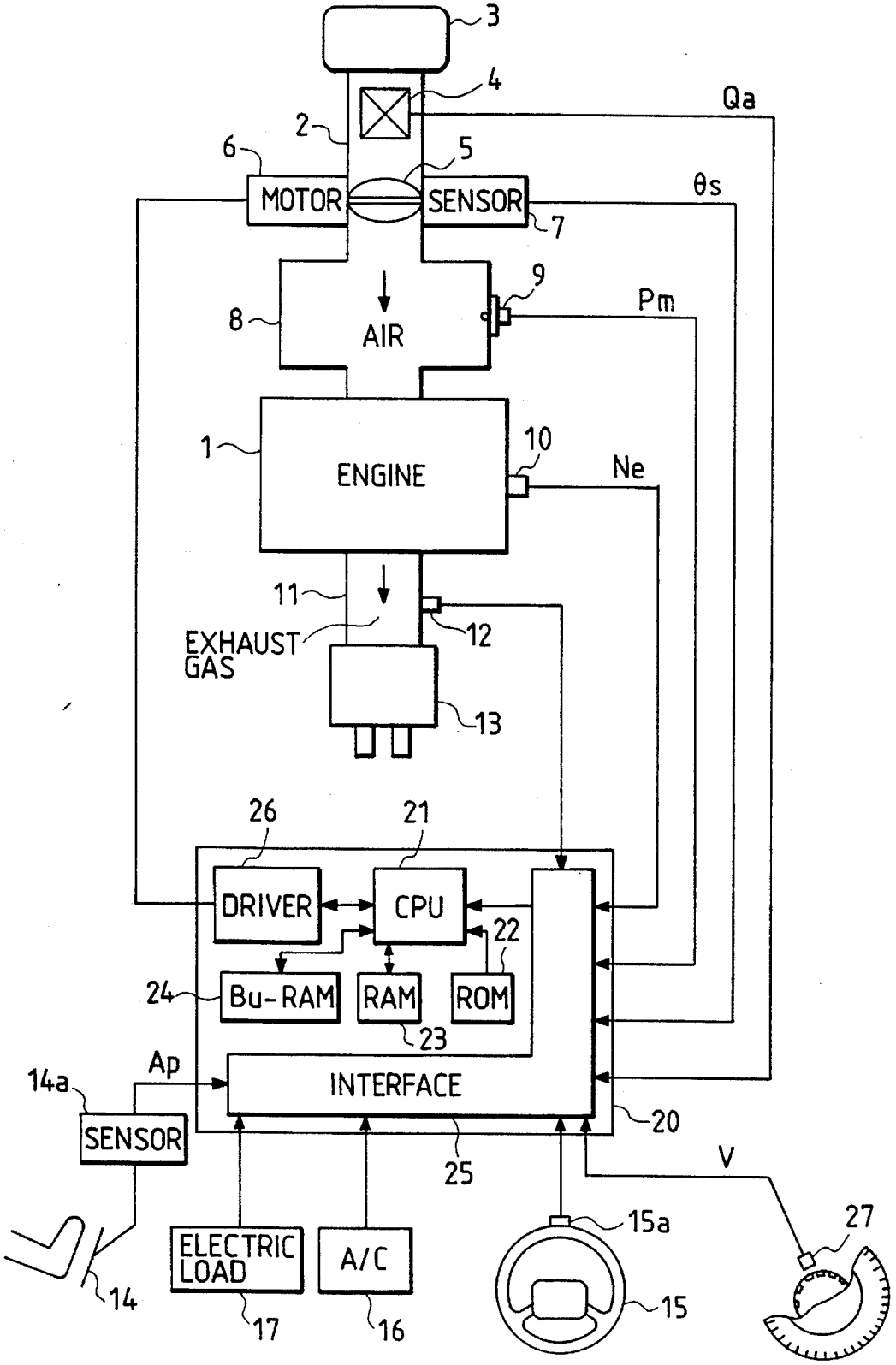
FIG. 3 is a diagram of a throttle control apparatus according to a third embodiment of this invention.

With reference to FIG. 3, an internal combustion engine 1 mounted on an automotive vehicle body (not shown) has an air induction passage 2. An air cleaner 3 is provided in an upstream end of the air induction passage 2. An air flow meter 4 provided in the air induction passage 2 downstream of the air cleaner 3 detects the rate Qa of air flow into a main body of the engine 1 via the air cleaner 3 and the air induction passage 2. The air flow meter 4 outputs a signal representing the detected air flow rate Qa.

A movable or rotatable throttle valve 5 is provided in the air induction passage 2 downstream of the air flow meter 4. The air flow rate Qa is varied with the position of the throttle valve 5. The throttle valve 5 is driven by a DC motor 6. A position sensor 7 associated with the throttle valve 5 detects the degree of opening of the throttle valve 5, that is, the position of the throttle valve 5. The throttle opening degree sensor 7 outputs a signal corresponding to a value or quantity θs representing the detected degree of opening of the throttle valve 5.

The air induction passage 2 downstream of the throttle valve 5 is provided with a surge tank 8 in which a pressure sensor 9 is disposed. The pressure sensor 9 detects the pressure Pm in the air induction passage 2 downstream of the throttle valve 5, and outputs a signal representing the detected pressure (air induction passage pressure) Pm. An engine speed sensor or a crank angle sensor 10 associated with the crankshaft of the engine 1 outputs a signal representing the rotational speed Ne of the engine 1.

The engine 1 has an exhaust passage 11 in which an $O_2$ sensor 12 is disposed. The $O_2$ sensor 12 detects the oxygen concentration of exhaust gas emitted from the main body of the engine 1. Since the oxygen concentration of exhaust gas depends on the air-to-fuel ratio (A/F ratio) of an air-fuel mixture drawn into the main body of the engine 1 which causes the exhaust gas, the output signal of the $O_2$ sensor 12 represents the A/F ratio of the air-fuel mixture. A muffler 13 is provided at a downstream end of the exhaust passage 11.

A position sensor 14*a* associated with a vehicle accelerator pedal 14 detects the degree Ap of depression of the accelerator pedal 14 (the position of the accelerator pedal 14), and outputs a signal representing the detected accelerator depression degree Ap.

A sensor 27 provided on the vehicle body detects the speed V of the vehicle body, and outputs a signal representing the detected vehicle speed V.

An electronic control unit 20 includes a combination of a CPU 21, a ROM 22, a RAM 23, a backup RAM 24, an interface 25, and a DC motor driver 26, The ROM 22 stores a program for controlling the CPU 21. In addition, the ROM 22 stores fixed data used in data processing by the CPU 21. The RAM 23 temporarily stores data handled and processed by the CPU 21. The backup RAM 24 includes a read/write memory which can hold data even if an engine ignition switch (not shown) is changed to an OFF position.

The CPU 21 is connected via the interface 25 to the air flow meter 4, the throttle opening degree sensor 7, the engine speed sensor 10, the $O_2$ sensor 12, the accelerator position sensor 14*a*, and the vehicle speed sensor 27, being informed of the air flow rate Qa, the detected value θs of the throttle opening degree, the engine speed Ne, the A/F ratio of an air-fuel mixture, the accelerator depression degree Ap, and the vehicle speed V thereby.

A switch 15*a* connected to a power steering 15 detects power assisting conditions of the power steering 15, and outputs a signal representing the detected conditions of the power steering 15. A switch 16 connected to a vehicle air conditioner (A/C) outputs a signal representative of operating conditions of the air conditioner. An electric load switch 17 outputs a signal representing operating conditions of an electric load such as a vehicle headlight.

The CPU 21 is connected via the interface 25 to the power steering switch 15*a*, the air conditioner switch 16, and the electric load switch 17, being informed of the conditions of the power steering 15, the operating conditions of the air conditioner, and the operating conditions of the electric load thereby.

A temperature sensor (not shown in FIG. 3) provided in the engine 1 detects the temperature of coolant of the engine 1, and outputs a signal representing the detected engine coolant temperature. A rotational speed sensor (not shown in FIG. 3) associated with a vehicle drive wheel detects the rotational speed of the vehicle drive wheel, and outputs a signal representing the detected vehicle wheel speed.

The CPU 21 is connected via the interface 25 to the coolant temperature sensor and the vehicle wheel speed sensor, being informed of the detected engine coolant temperature and the detected vehicle wheel speed thereby.

Fuel is injected into the engine 1 via electrically-driven fuel injection valves (not shown). The fuel injection valves are connected to the electronic control unit 20. The CPU 21 operates to control the fuel injection valves and thereby adjust the rate of fuel injection into the engine 1 in response to the air flow rate Qa and the engine speed Ne detected by the air flow meter 4 and the engine speed sensor 10. The CPU 21 also functions to adjust the fuel injection rate in response to the A/F ratio of the air-fuel mixture detected by the $O_2$ sensor 12 so that the A/F ratio can be feedback-controlled at a suitable ratio.

The CPU 21 calculates a command value of the degree of opening of the throttle valve 5 on the basis of the engine speed Ne and the accelerator depression degree Ap. The CPU 21 generates a control signal in response to the calculated command value of the throttle opening degree, and outputs the control signal to the DC motor driver 26. The DC motor driver 26 generates a pulse signal in response to the received control signal. The pulse signal has a duty cycle or factor which depends on the command value of the throttle opening degree. The DC motor driver 26 outputs the pulse signal to the DC motor 6 so that the DC motor 6 is driven by the pulse signal. Thus, the throttle valve 5 is driven in accordance with the pulse signal. The drive of the throttle valve 5 is designed so that the actual degree of opening of the throttle valve 5 can be controlled at the command value. As will be made clear later, the control of the degree of opening of the throttle valve 5 is responsive to the detected value θs of the throttle opening degree, a corrective quantity (value) θG, and a target throttle opening degree θT.

In this embodiment, a proper relation between an air flow rate and a throttle opening degree is preset, and a difference between an actual throttle opening degree and a proper throttle opening degree is determined by referring to the relation. The determined difference is learned as an indication of an error (which corresponds to the corrective value θG). The error is corrected to nullify the difference. Therefore, an offset of the origin which forms a base of control is removed, and high accuracy and reliability of control are attained.

When the engine 1 is idling, the CPU 21 executes idle speed control (ISC) designed to maintain the engine speed at a desired idle speed. During idle speed control, the CPU 21 operates to slightly move the throttle valve 1 from its fully closed position and to adjust the air flow rate Qa in response to an after-correction throttle opening degree θTH. In addition, during idle speed control, the CPU 21 executes an ISC learning process in which an feedback quantity GIFB is moved into an ISC learned quantity (value) GILRN before the ISC learned quantity GILRN is stored into the backup RAM 24. At a restart of the engine 1, the CPU 21 immediately executes suitable idle speed control in response to the ISC learned quantity GILRN read out from the backup RAM 24.

Figure 4:
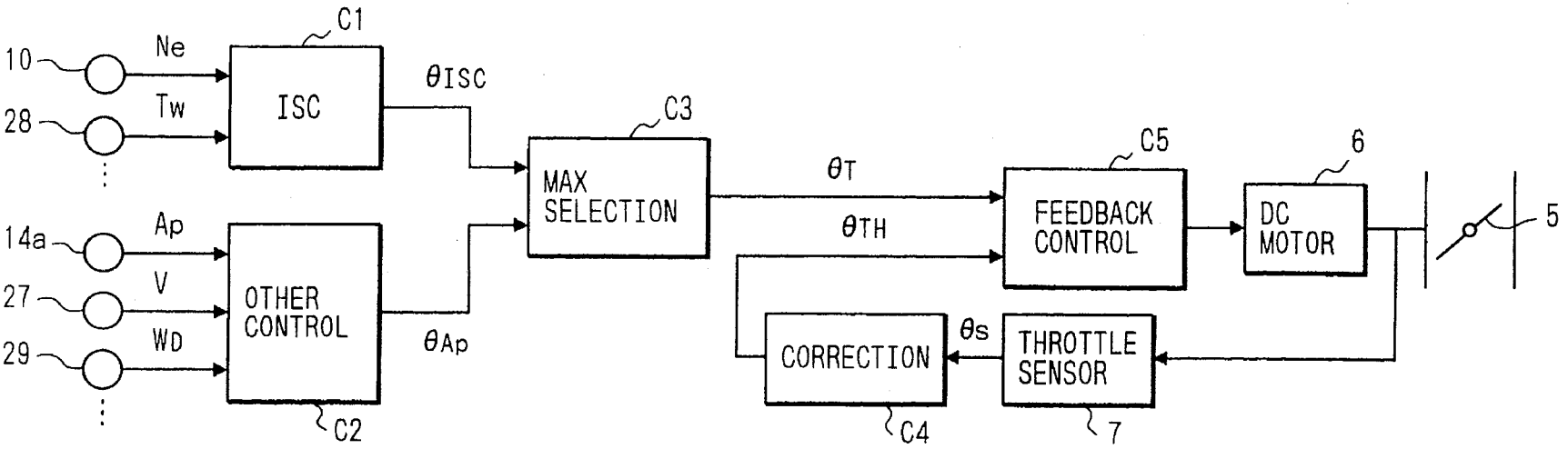
FIG. 4 is a diagram of a flow of operation of an electronic control unit in the apparatus of FIG. 3.

As shown in FIG. 4, the flow of operation of the electronic control unit 20 (the CPU 21) has blocks C1–C5. The block C1 calculates an ISC target throttle opening degree θISC on the basis of the engine speed Ne and the coolant temperature TW informed by the engine speed sensor 10 and an engine coolant temperature sensor 28. The ISC target throttle opening degree θISC is designed to control the engine speed Ne at a predetermined idle speed NIDL.

The block C2 calculates a target throttle opening degree θAP on the basis of the accelerator depression degree Ap informed by the accelerator position sensor 14*a*. The block C2 may have an automotive cruise control function or an automotive traction control function. In cases where a cruise control switch is changed to an active position, the block C2 calculates a target throttle opening degree θCC on the basis of the vehicle speed V informed by the vehicle speed sensor 27, and the calculated target throttle opening degree θCC replaces the target throttle opening degree θAP. The target throttle opening degree θCC is designed to control the vehicle speed V at a desired vehicle speed. During start or acceleration of the vehicle, when a slip is detected by referring to the output detection value WD of a vehicle wheel speed sensor 29, the block C2 calculates a target throttle opening degree θTT which is designed to suppress the slip, and the calculated target throttle opening degree θTT replaces the target throttle opening degree θAP.

Figure 5:
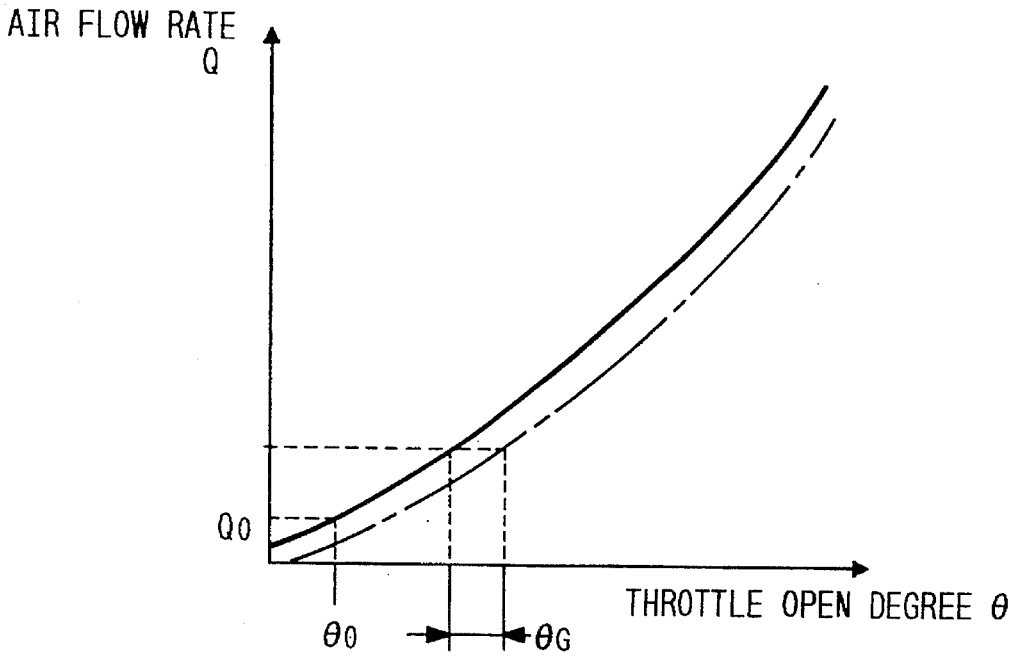
FIG. 5 is a relation between an air flow rate and a throttle opening degree in the apparatus of FIG. 3.

In FIG. 5, the solid line denotes the relation between the throttle opening degree θ and the air flow rate Q which is estimated during the designing of the engine or the automotive vehicle. A given minimum air flow rate Qo is predetermined. The target throttle opening degrees θISC, θAP, θCC, and θTT are output from the blocks C1 and C2 while the throttle opening degree θo which provides the predetermined minimum air flow rate Qo is used as a reference. In other words, the target throttle opening degrees θISC, θAP, θCC, and θTT are expressed with respect to a reference given by the predetermined minimum air flow rate Qo.

The block C3 following the blocks C1 and C2 selects the greatest target throttle opening degree θT from among the target throttle opening degrees θISC, θAP, θCC, and θTT.

The throttle opening degree which is represented by the output signal of the throttle opening degree sensor 7 is now referred to as the detected throttle opening degree θ. In FIG. 5, the broken line denotes the relation between the detected throttle opening degree θ and the air flow rate Q. This relation is now referred to as the detected relation. Generally, the detected relation deviates from the estimated relation by a quantity corresponding to an error θG in the detection output value θs from the throttle opening degree sensor 7. The signal error θG is caused by various factors such as a temperature-dependent drift of the output signal of the sensor 7, an error of the attachment of the sensor 7, or an error in the dimensions of a throttle body. It should be noted that the signal error corresponds to the corrective quantity θG. The block C4 corrects the error θG in the output value θs from the throttle opening degree sensor 7, and thereby revises the output value θs into an error-free detected throttle opening degree θTH.

The block C5 following the blocks C3 and C4 functions to adjust the duty cycle of the drive signal to the DC motor 6 in response to the target throttle opening degree θT and the detected throttle opening degree θTH. The adjustment of the duty cycle is designed so that the detected throttle opening degree θTH can be controlled at the target throttle opening degree θT.

Figure 6:
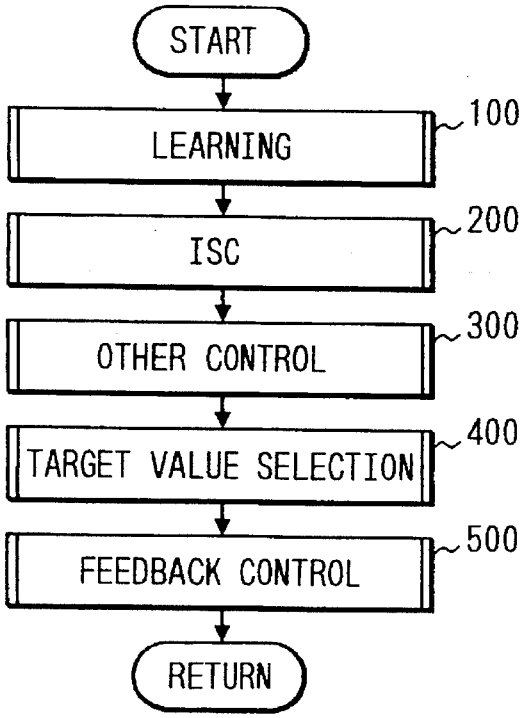
FIG. 6 is a flowchart of a segment of a program for controlling a CPU in the apparatus of FIG. 3.

As previously described, the CPU 21 operates in accordance with a program stored in the ROM 22. FIG. 6 is a flowchart of a throttle control routine of the program which is periodically reiterated.

As shown in FIG. 6, a first block 100 of the throttle control routine leas the signal error θG as a throttle fully-closed position reference value. A block 200 following the block 100 calculates an ISC target throttle opening degree θISC for idle speed control (ISC). A block 300 subsequent to the block 200 calculates a target throttle opening degree θAP for control other than ISC. A block 400 following the block 300 selects the greatest target throttle opening degree θT from among the target throttle opening degrees θISC and θAP. A block 500 subsequent to the block 400 executes a process of adjusting the duty cycle of the drive signal to the DC motor 6 in response to the target throttle opening degree θT and an error-free detected throttle opening degree θTH. The adjustment of the duty cycle is designed so that the detected throttle opening degree θTH can be controlled at the target throttle opening degree θT. After the block 500, the program returns to a main routine.

A main part of the block 500 may be replaced by hardware including an electric feedback control circuit. In this case, the block 500 informs the feedback control circuit of the target throttle opening degree θT and the detected throttle opening degree θTH.

Figure 7:
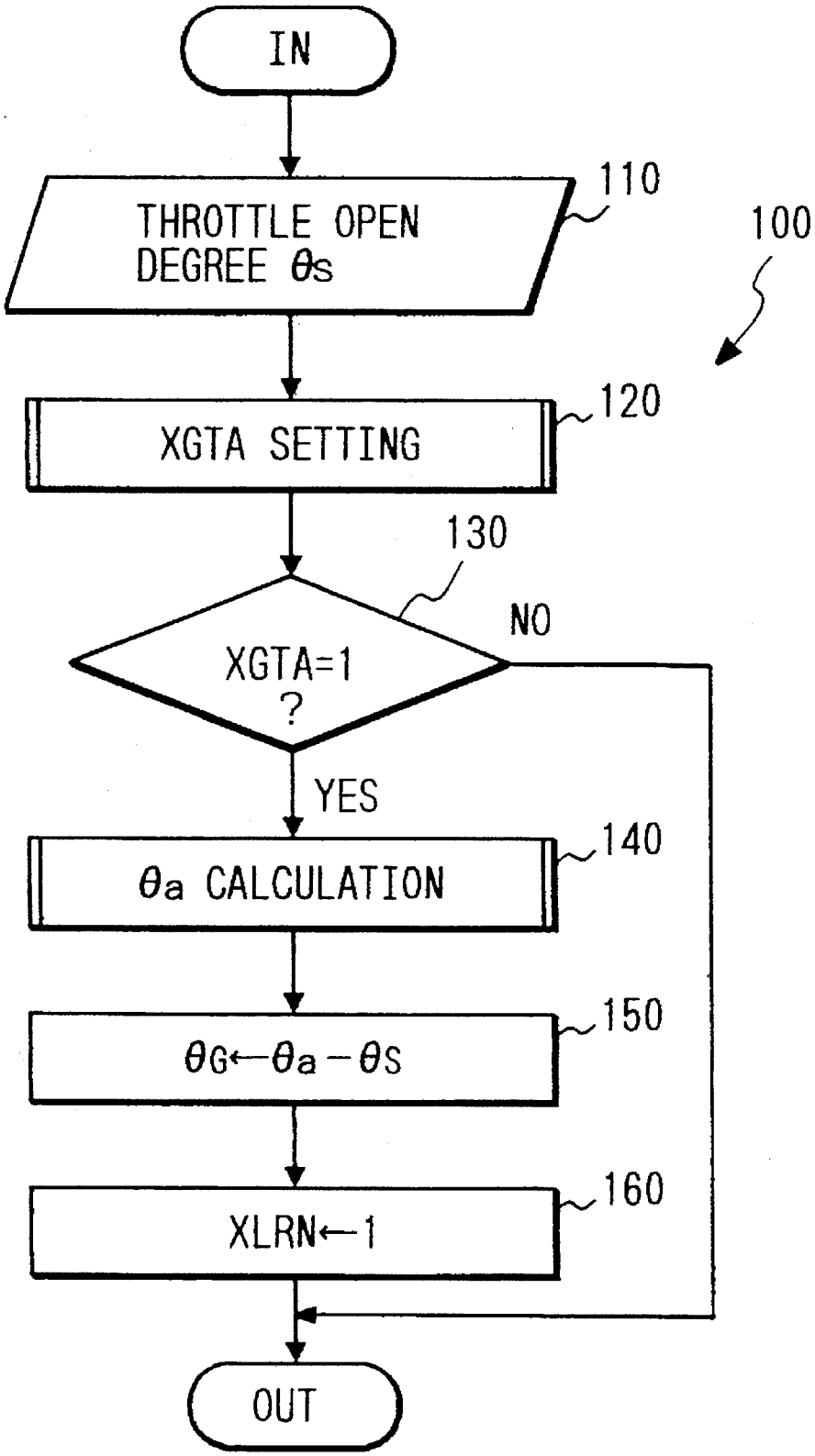
FIG. 7 is a flowchart of details of a block in FIG. 6.
Figure 8:
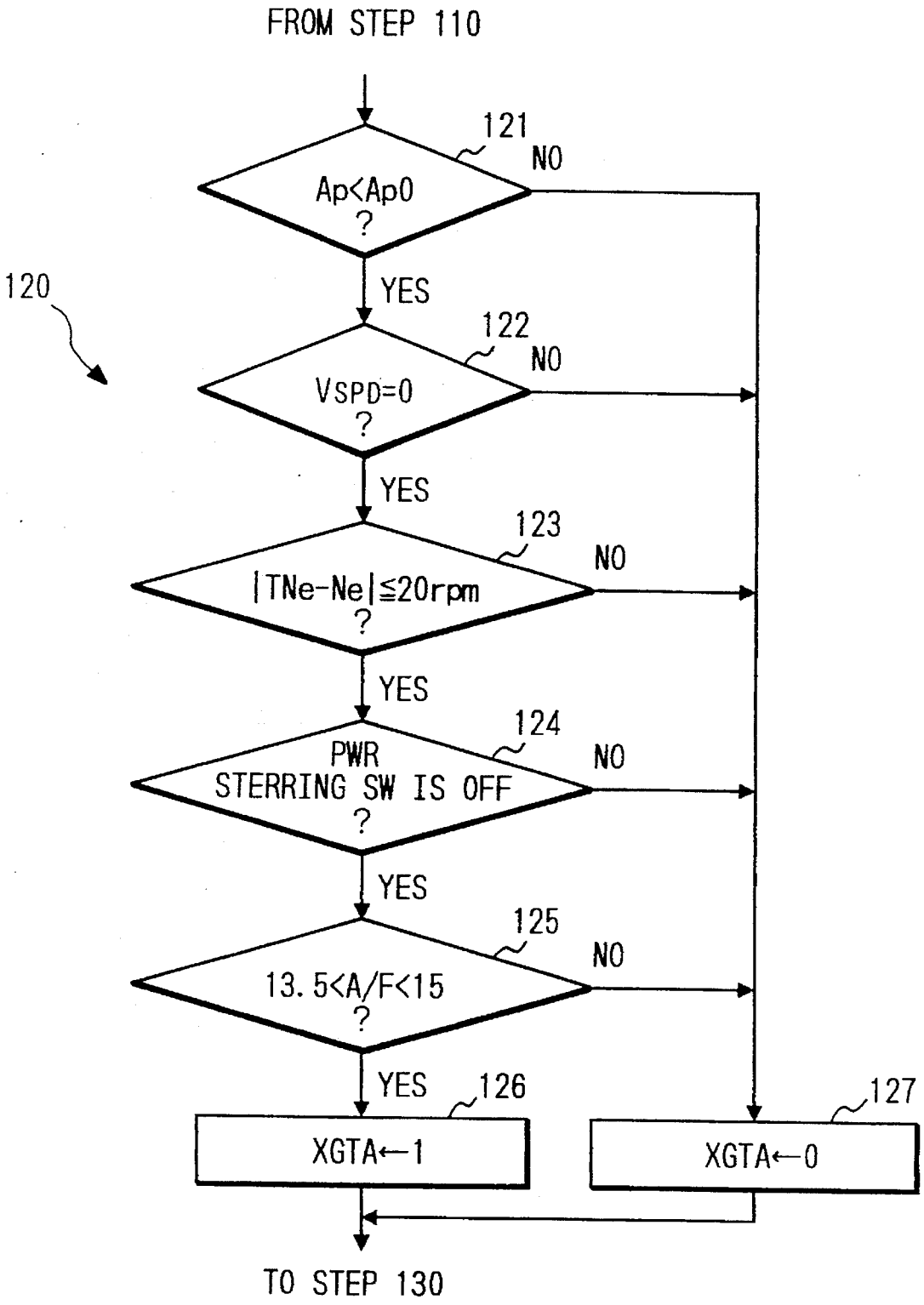
FIG. 8 is a flowchart of details of a block in FIG. 7.

FIG. 7 shows details of the learning block 100 of FIG. 6. As shown in FIG. 7, a first step 110 of the learning block 100 derives the current detected value θs of the throttle opening degree from the output signal of the throttle opening degree sensor 7. The step 110 is followed by a block 120 for setting a corrective value updating flag XGTA. The XGTA setting block 120 executes a determination regarding whether or not predetermined conditions for updating a throttle opening degree corrective value θG are satisfied. Details of the XGTA setting block 120 are shown in FIG. 8. Specifically, after the step 110, the program advances to a step 121 of FIG. 8.

In FIG. 8, the step 121 and subsequent steps 122 and 123 determine whether or not the engine 1 is idling and is in predetermined steady operating conditions. In more detail, the step 121 derives the current accelerator depression degree Ap from the output signal of the accelerator position sensor 14*a*. Then, the step 121 determines whether or not the current accelerator depression degree Ap is smaller than a predetermined accelerator undepression judgment value (degree) Ap0, that is, whether or not the engine 1 is idling and ISC is currently executed. When the current accelerator depression degree Ap is smaller than the predetermined degree Ap0, that is, when the engine 1 is idling and ISC is currently executed, the program advances from the step 121 to the step 122. Otherwise, the program advances from the step 121 to a step 127. The step 122 derives the current vehicle speed VSPD from the output signal of the vehicle speed sensor 27. Then, the step 122 determines whether or not the current vehicle speed VSPD is equal to zero. When the current vehicle speed VSPD is equal to zero, the program advances from the step 122 to the step 123. Otherwise, the program advances from the step 122 to the step 127. The step 123 derives the current engine speed Ne from the output signal of the engine speed sensor 10. Then, the step 123 calculates the difference between the current engine speed Ne and a predetermined target idle speed TNe. Finally, the step 123 compares the absolute value of the calculated difference with a predetermined speed value to determine whether or not ISC is good. The predetermined speed value corresponds to, for example, 20 rpm. When the absolute value of the difference is equal to or smaller than the predetermined speed value, that is, when ISC is good, the program advances from the step 123 to a step 124. Otherwise, the program advances from the step 123 to the step 127.

The step 124 determines whether or not the power steering switch 15*a* is in an OFF position, that is, whether or not a load which occurs during a power assisting process is acting on the engine 1. When the power steering switch 15*a* is in the OFF position, that is, when a load which occurs during a power assisting process is not acting on the engine 1, the program advances from the step 124 to a step 125. Otherwise, the program advances from the step 124 to the step 127. The step 125 derives the current A/F ratio of an air-fuel mixture from the output signal of the $O_2$ sensor 12. Then, the step 125 determines whether or not the current A/F ratio is in a predetermined rage around the stoichiometric value. For example, the predetermined rage extends between 13.5 and 15.0. When the current A/F ratio is in the predetermined range, the program advances from the step 125 to a step 126. Otherwise, the program advances from the step 125 to the step 127. An air flow rate Qa is used as a base for calculation of an estimated value θa of the throttle opening degree. An air flow rate Qa causing an A/F ratio outside the predetermined range would cause the estimated value θa of the throttle opening degree to be inaccurate, and thus the step 125 prevents such an air flow rate Qa from being used in calculation of the estimated value θa of the throttle opening degree.

The step 126 sets the corrective value updating flag XGTA to "1". The flag XGTA being "1" indicates that the predetermined conditions for updating the throttle opening degree corrective value θG are satisfied. On the other hand, the step 127 resets the corrective value updating flag XGTA to "0". The flag XGTA being "0" indicates that the predetermined conditions for updating the throttle opening degree corrective value θG are not satisfied. After the steps 126 and 127, the program exits from the XGTA setting block 120 and advances to a step 130 of FIG. 7.

The step 130 determines whether or not the corrective value updating flag XGTA is equal to "1". When the flag XGTA is equal to "1",the program advances from the step 130 to a block 140 for calculating an estimated value θa of the throttle opening degree. Otherwise, the program advances from the step 130 and exits from the learning block 100 of FIG. 6 before proceeding to the ISC block 200 of FIG. 6.

Figure 9:
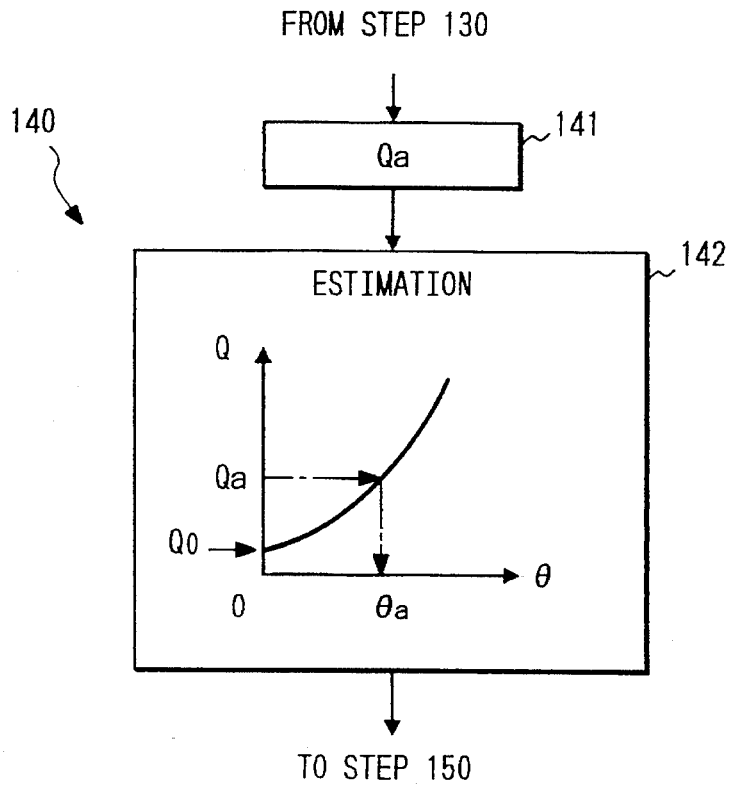
FIG. 9 is a flowchart of details of a block in FIG. 7.

FIG. 9 shows details of the estimated-value calculating block 140. Upon the advance of the program from the step 130 to the block 140 of FIG. 7, the program proceeds to a step 141 of FIG. 9. The step 141 derives the current air flow rate Qa from the output signal of the air flow meter 4. A step 142 following the step 141 calculates an estimated value ea of the throttle opening degree from the current air flow rate Qa by referring to a map which determines the relation between the air flow rate and the estimated throttle opening degree. Data representing the map is previously stored into the ROM 22. Specifically, the map corresponds to a curved line exactly or approximately representing the θa-Qa relation which passes through a leak air flow rate Qo occurring at a throttle opening degree of "0". After the step 142, the program exits from the estimated-value calculating block 140 and advances to a step 150 of FIG. 7.

The step 150 calculates a current corrective value θG for the throttle opening degree which equals the estimated value θa of the throttle opening degree minus the detected value θs of the throttle opening degree. The estimated value θa and the detected value θs are given by the previous block 140 and the previous step 110 respectively. The step 150 replaces a previous corrective value θG, which is stored in the backup RAM 24, with the current corrective value θG to update the corrective value.

A step 160 following the step 150 sets a flag XLRN for allowing an ISC learning process to "1". The learning allowance flag XLRN being "1" indicates that predetermined conditions for executing the ISC learning process are satisfied. After the step 160, the program exits from the learning block 100 of FIG. 6 before proceeding to the ISC block 200 of FIG. 6.

As previously described, in cases where the corrective value updating flag XGTA is set to "1", the step 150 updates the corrective value θG for the throttle opening degree in response to the estimated value θa and the detected value θs of the throttle opening degree. The updating of the corrective value θG enables the continuous execution of suitable correction of an error in the output signal of the throttle opening degree sensor 7.

While the updating of the corrective value θG is executed many times as long as the corrective value updating flag XGTA is "1" after the start of the engine 1 in this embodiment, the number of times of the execution of the updating may be limited to one. In this case, between the steps 130 and 140, a new step is added which determines whether or not the corrective value θG has been updated after the start of the engine 1. When the corrective value θG has been updated after the start of the engine 1, the program advances from the new step to the step 140. Otherwise, the program advances from the new step to the ISC block 200 of FIG. 6.

Figure 10:
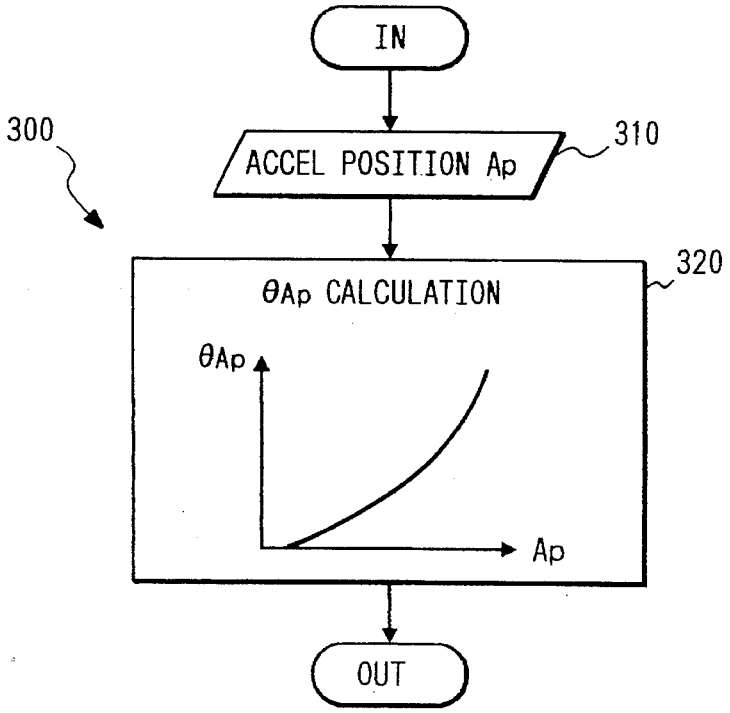
FIG. 10 is a flowchart of details of a block in FIG. 6.

As previously described, the block 300 of FIG. 6 calculates a target throttle opening degree θAP for control other than ISC. FIG. 10 shows details of the block 300. As shown in FIG. 10, a first step 310 of the block 300 derives the current accelerator position (the current accelerator depression degree) AP from the output signal of the accelerator position sensor 14*a*. A step 320 following the step 310 calculates a target throttle opening degree θAP from the current accelerator position AP by referring to a map which determines the relation between the target throttle opening degree and the accelerator position. Data representing the map is previously stored into the ROM 22. After the step 320, the program exits from the block 300 and advances to the block 400 of FIG. 6.

Figure 11:
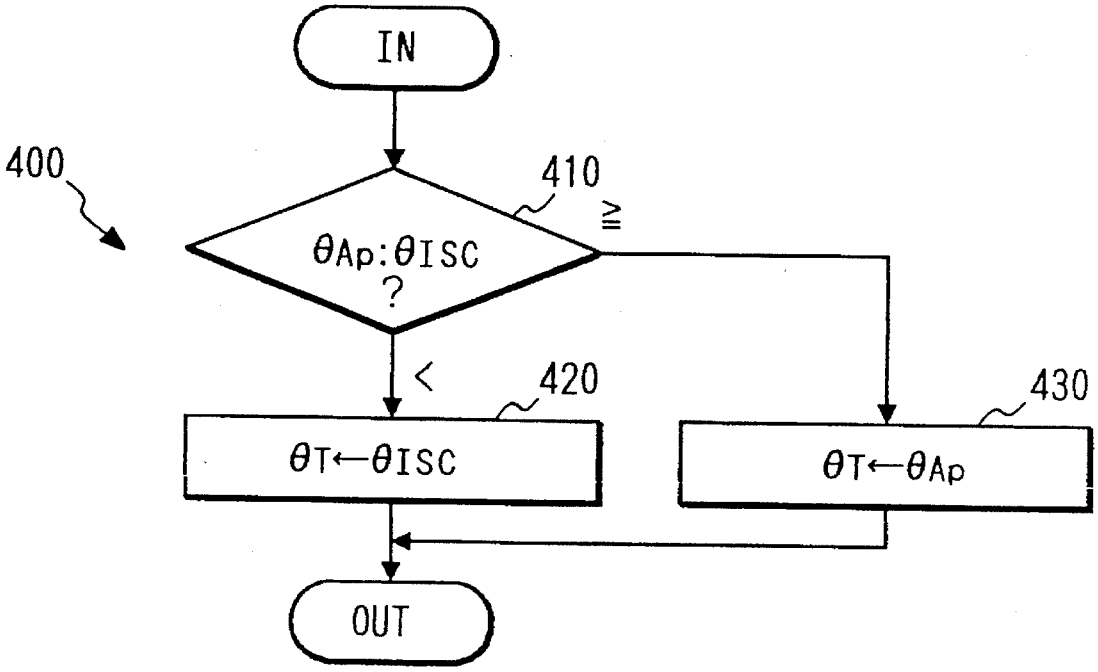
FIG. 11 is a flowchart of details of a block in FIG. 6.

As previously described, the block 400 of FIG. 6 selects the greatest target throttle opening degree θT from among the target throttle opening degrees θISC and θAP. FIG. 11 shows details of the block 400. As shown in FIG. 400, a first step 410 of the block 400 compares the target throttle opening degrees θISC and θAP with each other. When the target throttle opening degree θAP is smaller than the target throttle opening degree θISC, the program advances from the step 410 to a step 420 which sets the target throttle opening degree θT equal to the target throttle opening degree θISC. When the target throttle opening degree θAP is equal to or greater than the target throttle opening degree θISC, the program advances from the step 410 to a step 430 which sets the target throttle opening degree θT equal to the target throttle opening degree θAP. After the steps 420 and 430, the program exits from the block 400 and advances to the block 500 of FIG. 6.

Figure 12:
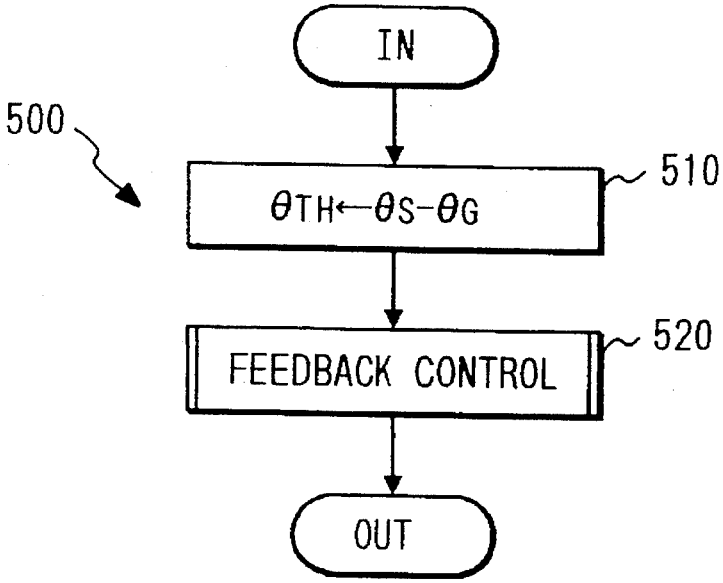
FIG. 12 is a flowchart of details of a block in FIG. 6.

As previously described, the block 500 of FIG. 6 executes a process of adjusting the duty cycle of the drive signal to the DC motor 6 in response to the target throttle opening degree θT and an error-free detected throttle opening degree θTH. FIG. 12 shows details of the block 500. As shown in FIG. 12, a first step 510 of the block 500 corrects the current detected value θs of the throttle opening degree into an error-free detected throttle opening degree θTH in response to the corrective value θG. Specifically, the step 510 subtracts the corrective value θG from the current detected value θs of the throttle opening degree, and sets the error-free detected throttle opening degree θTH equal to the result of the subtraction. A step 520 following the step 510 executes a process of feedback-controlling the rotational position of the output shaft of the DC motor 6 in response to the error-free detected throttle opening degree θTH and the target throttle opening degree θT. The feedback control provides adjustment of the actual degree of opening of the throttle valve 5.

It should be noted that details of the ISC block 200 of FIG. 6 will be described later.

Figure 13:
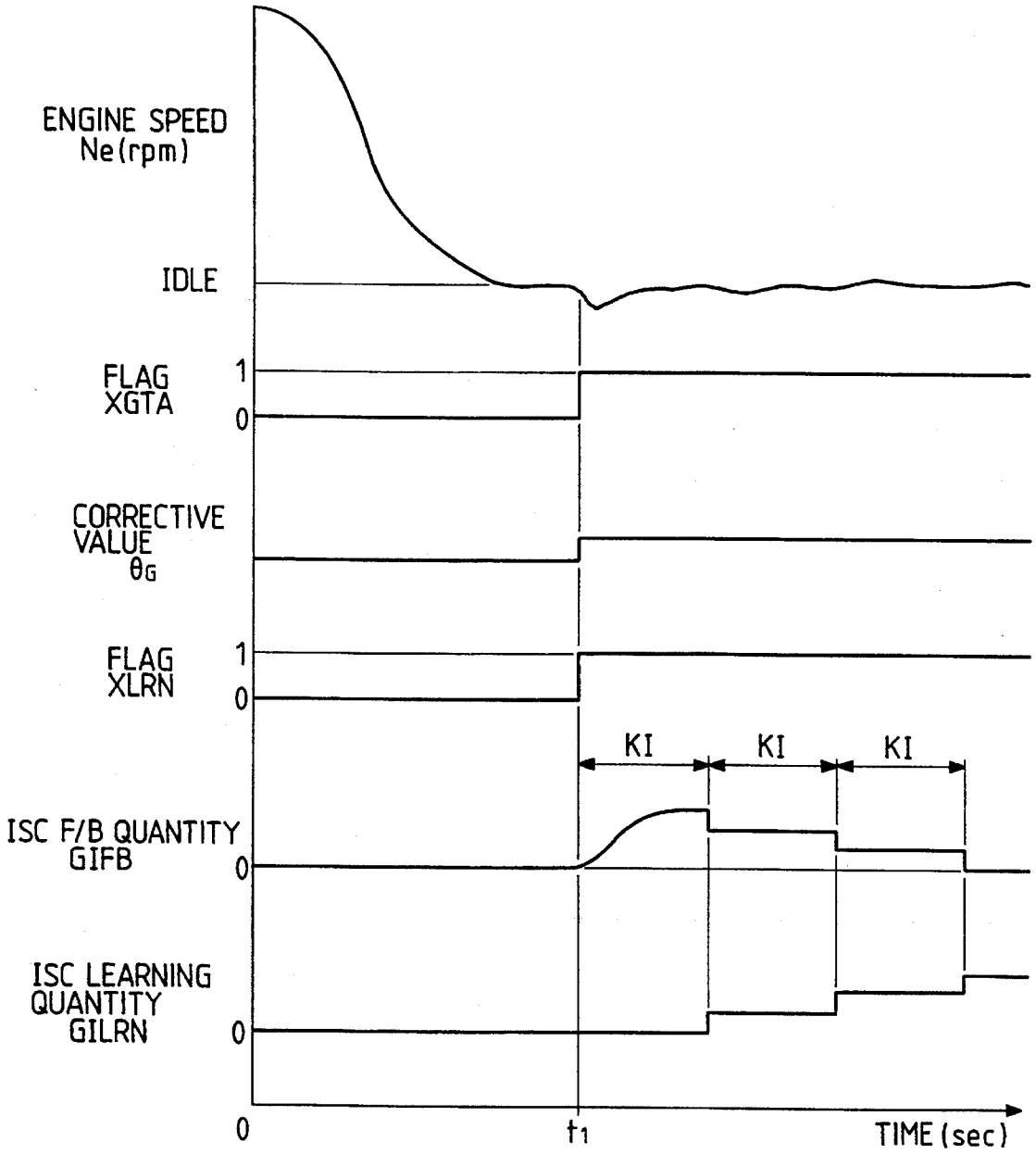
FIG. 13 is a time-domain diagram of an example of conditions of various parameters; in the apparatus of FIG. 3.

FIG. 13 shows an example of time-domain variations in conditions of ISC in this embodiment. With reference to FIG. 13, when the engine speed Ne decreases and thus the engine 1 falls into an idling state, the CPU 21 starts ISC. During the execution of ISC, the CPU 21 operates to control the actual degree of opening of the throttle valve 5 via the DC motor 6 in response to the error-free detected throttle opening degree θTH so that the engine speed Ne can be maintained at the target idle speed. At a moment t1 which follows the moment of the start of ISC, the predetermined conditions for updating the corrective value θG are satisfied and therefore the corrective value updating flag XGTA is set to "1". When the flag XGTA is set to "1", the corrective value θG for the detected throttle opening degree is updated and the flag XLRN for allowing the ISC learning process is set to "1". The updating of the corrective value θG results in a change of the error-free detected throttle opening degree θTH. The control of the actual degree of opening of the throttle valve 5 in response to the changed detected throttle opening degree θTH would cause the engine speed Ne to deviate from the target idle speed. To maintain the engine speed Ne essentially at the target idle speed, the CPU 21 gradually increases an ISC feedback quantity GIFB in the direction corresponding to the difference between the engine speed Ne and the target idle speed. As a result of the increase in the ISC feedback quantity GIFB, the actual degree of the throttle valve 5 is varied and thus the engine speed Ne is made equal to the target idle speed. When the engine speed Ne becomes equal to the target idle speed, the present ISC feedback quantity GIFB is sampled and held.

Figure 14:
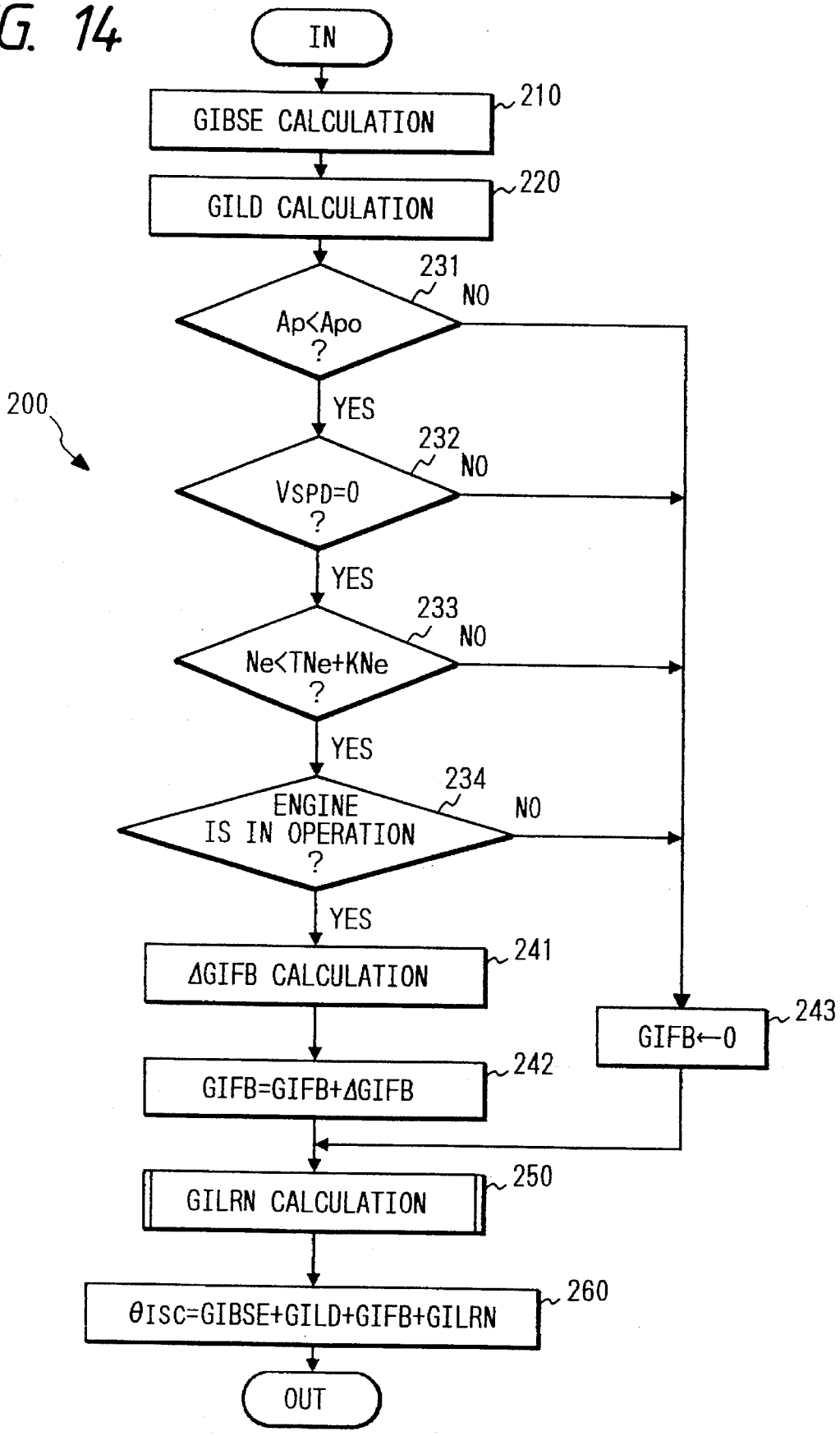
FIG. 14 is a flowchart of details of a block in FIG. 6.

As previously described, the ISC block 200 of FIG. 6 calculates the ISC target throttle opening degree θISC for idle speed control (ISC). FIG. 14 shows details of the ISC block 200. As shown in FIG. 14, a first step 210 of the ISC block 200 derives the current coolant temperature from the output signal of the engine coolant temperature sensor 28. Then, the step 210 calculates a base opening degree GIBES from the current coolant temperature by referring to a map or table which determines the relation between the base opening degree and the coolant temperature. Data representing the table is previously stored into the ROM 22.

A step 220 following the step 210 calculates a corrective opening degree GILD which varies as a function of a load on the engine 1. Specifically, the step 210 derives the current power assisting conditions of the power steering 15 from the output signal of the power steering switch 15*a*. In addition, the step 210 derives the current operating conditions of the air conditioner from the output signal of the air conditioner switch 16. Furthermore, the step 210 derives the current operating conditions of the electric load from the output signal of the electric load switch 17. The corrective opening degree GILD is determined in accordance with the current power assisting conditions of the power steering 15, the current operating conditions of the air conditioner, and the current operating conditions of the electric load by referring to a predetermined equation or a map provided in the ROM 22. It should be noted that the corrective opening degree GILD is equal to zero in the absence of the load on the engine 1 which is caused by the air conditioner, the electric load, and the power steering.

A step 231 following the step 220 determines whether or not the current accelerator depression degree Ap is smaller than the predetermined accelerator undepression judgment value (degree) Ap0. When the current accelerator depression degree Ap is smaller than the predetermined degree Ap0, the program advances from the step 231 to a step 232. Otherwise, the program advances from the step 231 to a step 243.

The step 232 determines whether or not the current vehicle speed VSPD is equal to zero. When the current vehicle speed VSPD is equal to zero, the program advances from the step 232 to a step 233. Otherwise, the program advances from the step 232 to the step 243.

The step 233 calculates the sum of the target idle speed TNe and a predetermined speed value KNe. Then, the step 233 compares the current engine speed Ne with the sum of the speeds TNe and KNe. When the current engine speed Ne is lower than the sum of the speeds TNe and KNe, the program advances from the step 233 to a step 234. Otherwise, the program advances from the step 233 to the step 243.

The step 243 determines whether or not the engine 1 is in operation. When the engine 1 is in operation, the program advances from the step 234 to a step 241. Otherwise, the program advances from the step 234 to the step 243.

The step 241 calculates the difference ΔNe between the current engine speed Ne and the target idle speed TNe. Then, the step 241 calculates an integrating quantity ΔGIFB for the ISC feedback quantity GIFB from the difference ΔNe between the speeds Ne and TNe by referring to a map or table which determines the relation between the integrating quantity and the speed difference. Data representing the table is previously stored into the ROM 22. The integrating quantity ΔGIFB is designed to satisfy the following conditions. When the difference ΔNe which equals the speed Ne minus the speed TNe is positive, the integrating quantity ΔGIFB is negative. When the difference ΔNe is negative, the integrating quantity ΔGIFB is positive. As the absolute value of the difference ΔNe increases, the absolute value of the integrating quantity ΔGIFB increases.

A step 242 following the step 241 increments the ISC feedback quantity GIFB by the integrating quantity ΔGIFB to integrate the ISC feedback quantity GIFB. After the step 242, the program advances to a block 250.

The step 243 sets the ISC feedback quantity GIFB equal to "0". After the step 243, the program advances to the block 250.

The block 250 calculates an ISC learned quantity GILRN. It should be noted that details of the block 250 will be described later.

A step 260 following the block 250 adds the base opening degree GIBSE, the corrective opening degree GILD, the ISC feedback quantity GIFB, and the ISC learned quantity GILRN into the ISC target throttle opening degree θISC. After the step 260, the program exists from the ISC block 200 of FIG. 6 and advances to the other control block 300 of FIG. 6.

Figure 15:
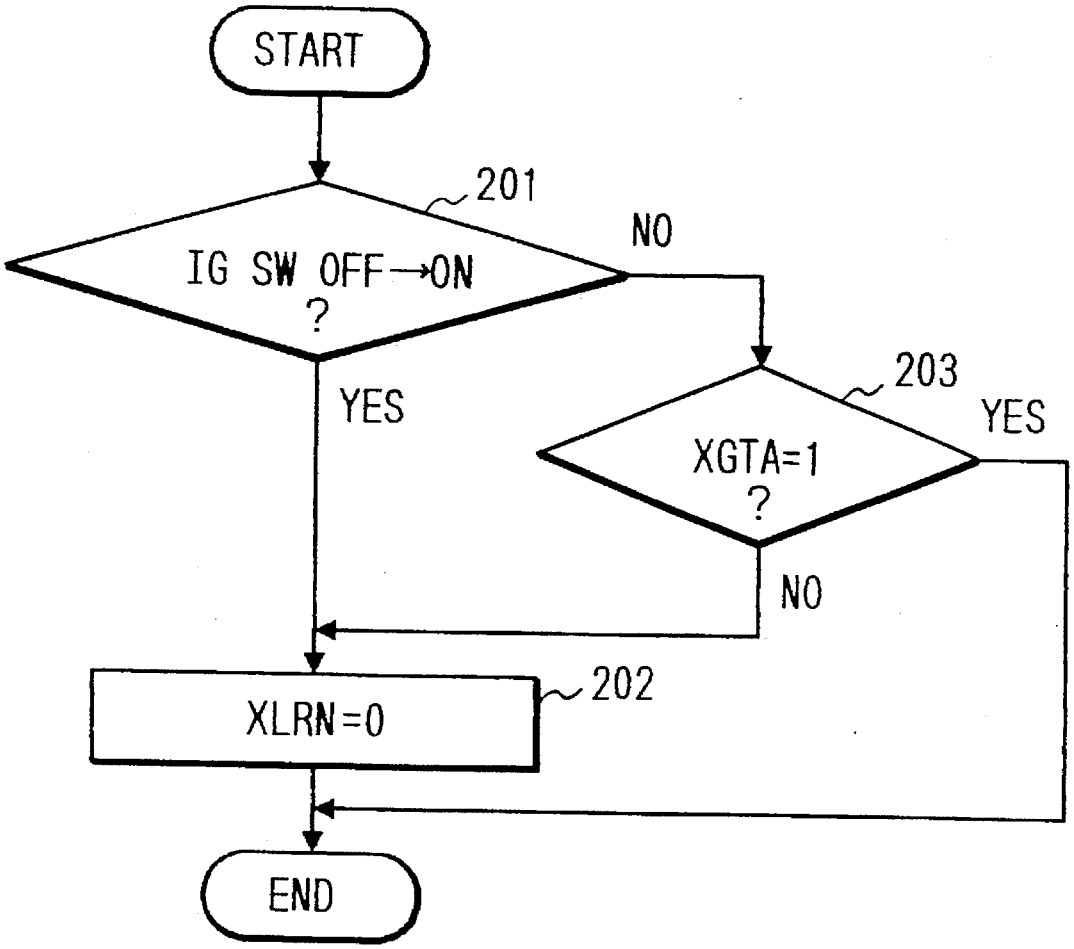
FIG. 15 is a flowchart of details of a segment of a block in FIG. 14.
Figure 16:
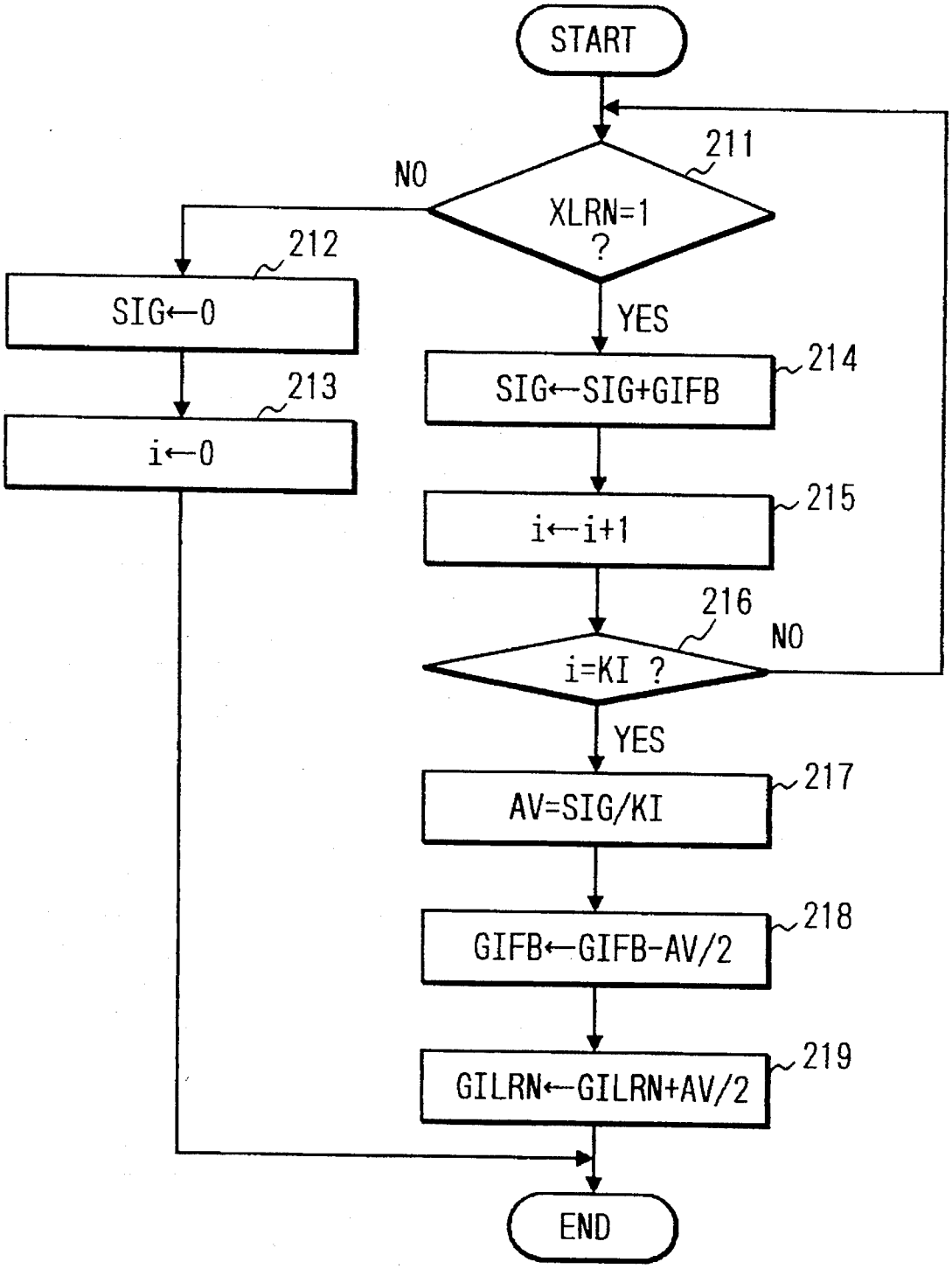
FIG. 16 is a flowchart of details of a segment of a block in FIG. 14.

As previously described, the block 250 of FIG. 14 calculates the ISC learned quantity GILRN. The block 250 includes a routine for resetting the learning allowance flag XLRN. FIG. 15 is a flowchart of the XLRN resetting routine. In addition, the block 250 includes an ISC learning routine. FIG. 16 is a flowchart of the ISC learning routine. The XLRN resetting routine and the ISC learning routine are reiterated at predetermined intervals of time.

As previously described, the learning allowance flag XLRN is set by the step 160 of FIG. 7 when the corrective quantity θG is updated. The learning allowance flag XLRN can be reset by the XLRN resetting routine of FIG. 15. As shown in FIG. 15, a first step 201 of the XLRN resetting routine determines whether or not the engine ignition switch is changed from the OFF position to the ON position. When the engine ignition switch is changed to the ON position, the program advances from the step 201 to a step 202 which resets the learning allowance flag XLRN to "0". The change of the engine ignition switch to the ON position means restart of the engine 1, and the updating of the corrective quantity θG remains unexecuted during the restart of the engine 1. Thus, the steps 201 and 202 cooperate to prevent the ISC learning process from being immediately executed upon the restart of the engine 1. When the engine ignition switch is not changed to the ON position, the program advances from the step 201 to a step 203. The step 203 determines whether or not the corrective value updating flag XGTA is equal to "1". When the flag XGTA is not equal to "1", the program advances from the step 203 to the step 202 which resets the learning allowance flag XLRN to "0". In other words, the flag XGTA being "0" is regarded as an indication that current operating conditions of the engine 1 are unsuited to the execution of the ISC learning process, and thus the flag XLRN is reset to "0" to prevent the execution of the ISC learning process when the flag XGTA is not equal to "1". The flag XLRN being "0" indicates that the predetermined conditions for executing the ISC learning process are not satisfied. When the flag XGTA is equal to "1", the program advances from the step 203 and the current execution cycle of the routine of FIG. 15 ends. In addition, after the step 202, the current execution cycle of the routine of FIG. 15 ends.

The XLRN resetting routine of FIG. 15 is followed by the ISC learning routine of FIG. 16. As shown in FIG. 16, a first step 211 of the ISC learning routine determines whether or not the learning allowance flag XLRN is equal to "1", that is, whether or not the corrective value θG is updated. When the flag XLRN is equal to "1", that is, when the corrective value θG is updated, the program advances from the step 211 to a step 214. Otherwise, the program advances from the step 211 to a step 212. The step 212 resets a feedback integration value SIG to "0". A step 213 following the step 212 resets a feedback frequency counter value "i" to "0". After the step 213, the current execution cycle of the routine of FIG. 16 ends.

The step 214 increments the feedback integration value SIG by the current ISC feedback quantity GIFB. A step 215 following the step 214 increments the feedback frequency counter value "i" by "1". A step 216 subsequent to the step 215 determines whether or not the feedback frequency counter value "i" is equal to a predetermined number KI. When the counter value "i" is equal to the predetermined number KI, the program advances from the step 216 to a step 217. Otherwise, the program returns from the step 216 to the step 211. Thus, as long as the flag XLRN is equal to "1", the steps 214 and 215 are reiterated and thus the increment of the feedback integration value SIG by the ISC feedback quantity GIFB is reiterated until the counter value "i" increases to the predetermined number KI.

The step 217 calculates an average feedback quantity AV which equals the feedback integration value SIG divided by the predetermined number KI. A step 218 following the step 217 decrements the ISC feedback quantity GIFB by a half of the average feedback quantity AV. A step 219 subsequent to the step 218 reads out the ISC learned value GILRN from the backup RAM 24. The step 219 increments the ISC learned value GILRN by a half of the average feedback quantity AV. The step 219 stores the incremented ISC learned value GILRN into the backup RAM 24. After the step 219, the current execution cycle of the routine of FIG. 16 ends.

With reference to FIG. 13, when the feedback frequency counter value "i" increases to the predetermined number KI, the ISC feedback quantity GIFB is decremented by a half of the average feedback quantity AV but the ISC learned value GILRN is incremented by a half of the average feedback quantity AV as a result of operation of the steps 218 and 219 of FIG. 16. In other words, a half of the average feedback quantity AV is moved from the ISC feedback quantity GIFB into the ISC learned value GILRN. As long as the step 211 of FIG. 16 continues to determine the learning allowance flag XLRN to be "1", the movement of a half of the average feedback quantity AV remains reiterated and finally the whole of the ISC feedback quantity GIFB is moved into the ISC learned value GILRN. Even after the engine ignition switch is changed to the OFF position and thus the engine 1 is stopped, the ISC learned value GILRN is held by the backup RAM 24. During restart of the engine 1, suitable idle speed control (ISC) is executed by referring to the ISC learned value GILRN stored in the backup RAM 24.

As previously described, a variation in characteristics from throttle valve to throttle valve and the ageing of the throttle valve 5 cause the output value of the throttle opening degree sensor 7 to deviate from a proper value well corresponding to operating conditions of the engine 1. It is possible to compensate for the deviation since the output value of the throttle opening degree sensor 7 is corrected in accordance with the corrective value θG and thus the throttle opening degree represented by the resultant of the correction of the output signal of the throttle opening degree sensor 7 well corresponds to the operating condition of the engine 1, that is, the air flow rate Qa. Thus, automotive traction control or automotive cruise control responsive to the corrected throttle opening degree is accurate and reliable.

As previously described, the corrective value θG can be updated provided that the engine 1 is in the predetermined steady operating conditions. Thus, even in cases where the throttle valve 5 is out of the fully-closed position, the corrective value θG can be updated when given conditions are satisfied. Accordingly, in a system where an engine stops when a throttle valve is moved to a mechanical fully-closed position, a system where detection of whether or not a throttle valve assumes a fully-closed position is difficult, or a system lacks a switch for detecting whether or not a throttle valve assumes a fully-closed position, the application of this embodiment thereto can correct a reference value corresponding to the throttle fully-closed position.

When the corrective value θG is updated, the learning allowance flag XLRN is set to "1". After the setting of the flag XLRN to "1" is detected, the process of learning the ISC control quantity is started. Thus, the ISC learning process is stated at a moment which surely follows the moment of completion of the updating of the corrective value θG. The updating of the corrective value θG is designed to compensate for a variation in characteristics between throttle opening degree sensor to throttle opening degree sensor and the ageing of the throttle opening degree sensor 7. The error-free detected throttle opening degree θTH is determined in response to the resultant of the updating of the corrective value θG. Then, the actual degree of opening of the throttle valve 5 is controlled in response to the error-free detected throttle opening degree θTH. The ISC feedback quantity GIFB which occurs during this control is used in calculating the ISC learned value GILRN. Thus, the ISC learning process is responsive to the corrective value θG which is determined in consideration of a variation in characteristics between throttle opening degree sensor to throttle opening degree sensor and the ageing of the throttle opening degree sensor 7. Accordingly, the ISC leaned value GILRN derived in the ISC learning process remains proper, and ISC continues to be accurate and reliable.

DESCRIPTION OF THE FOURTH PREFERRED EMBODIMENT

A fourth embodiment of this invention is similar to the embodiment of FIGS. 3–16 except for design changes indicated hereinafter. The fourth embodiment includes an estimated-value calculating block 140A which replaces the estimated-value calculating block 140 of FIGS. 7 and 9.

Figure 17:
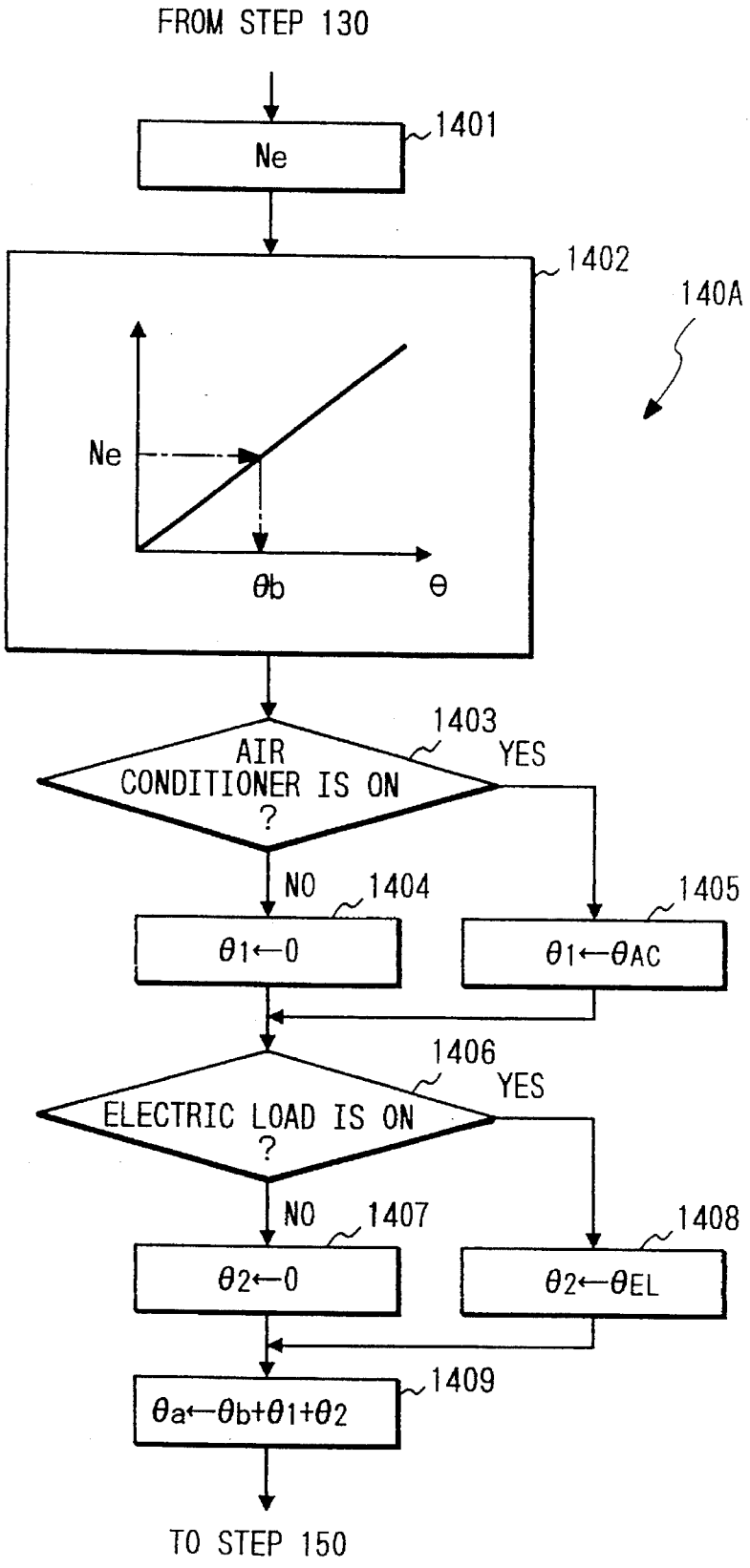
FIG. 17 is a flowchart of details of a program block in a throttle control apparatus according to a fourth embodiment of this invention.

FIG. 17 shows details of the estimated-value calculating block 140A. As shown in FIG. 17, a first step 1401 of the block 140A which follows the step 130 of FIG. 7 derives the current engine speed Ne from the output signal of the engine speed sensor 10 (see FIG. 3). A step 1402 following the step 1401 calculates a base opening degree θb from the current engine speed Ne by referring to a map which determines the relation between the base opening degree and the engine speed. Data representing the map is previously stored into the ROM 22 (see FIG. 3).

A step 1403 subsequent to the step 1402 determines whether or not the air conditioner switch 16 (see FIG. 3) is in the ON position, that is, whether or not the engine 1 (see FIG. 1) receives a load from the air conditioner, by referring to the output signal of the switch 16. When the air conditioner switch 16 is in the ON position, the program advances from the step 1403 to a step 1405. Otherwise, the program advances from the step 1403 to a step 1404. The step 1404 sets an air conditioner corrective quantity θ1 equal to "0". On the other hand, the step 1405 sets the air conditioner corrective quantity θ1 equal to a predetermined corrective quantity θAC corresponding to the air conditioner load on the engine 1.

A step 1406 following the steps 1404 and 1405 determines whether or not the electric load switch 17 (see FIG. 3) is in the ON position, that is, whether or not the engine 1 (see FIG. 1) receives the related electric load, by referring to the output signal of the switch 17. When the electric load switch 17 is in the ON position, the program advances from the step 1406 to a step 1408. Otherwise, the program advances from the step 1406 to a step 1407. The step 1407 sets an electric load corrective quantity θ2 equal to "0". On the other hand, the step 1408 sets the electric load corrective quantity θ2 equal to a predetermined corrective quantity θEL corresponding to the electric load on the engine 1.

A step 1409 following the steps 1407 and 1408 adds the base opening degree θb, the air conditioner corrective quantity θ1, and the electric load corrective quantity θ2 into an estimated value θa of the throttle opening degree. After the step 1409, the program exits from the estimated-value calculating block 140A and then advances to the step 150 of FIG. 7.

In this embodiment, the estimated value θa of the throttle opening degree is determined on the basis of the current engine speed Ne. Thus, the value represented by the resultant of the correction of the output signal of the throttle opening degree sensor 7 well corresponds, to the operating condition of the engine 1, and automotive traction control or automotive cruise control responsive to the resultant of the correction of the output signal of the throttle opening degree sensor 7 is accurate and reliable.

DESCRIPTION OF THE FIFTH PREFERRED EMBODIMENT

A fifth embodiment of this invention is similar to the embodiment of FIGS. 3–16 except for design changes indicated hereinafter. The fifth embodiment includes an estimated-value calculating block 140B which replaces the estimated-value calculating block 140 of FIGS. 7 and 9.

Figure 18:
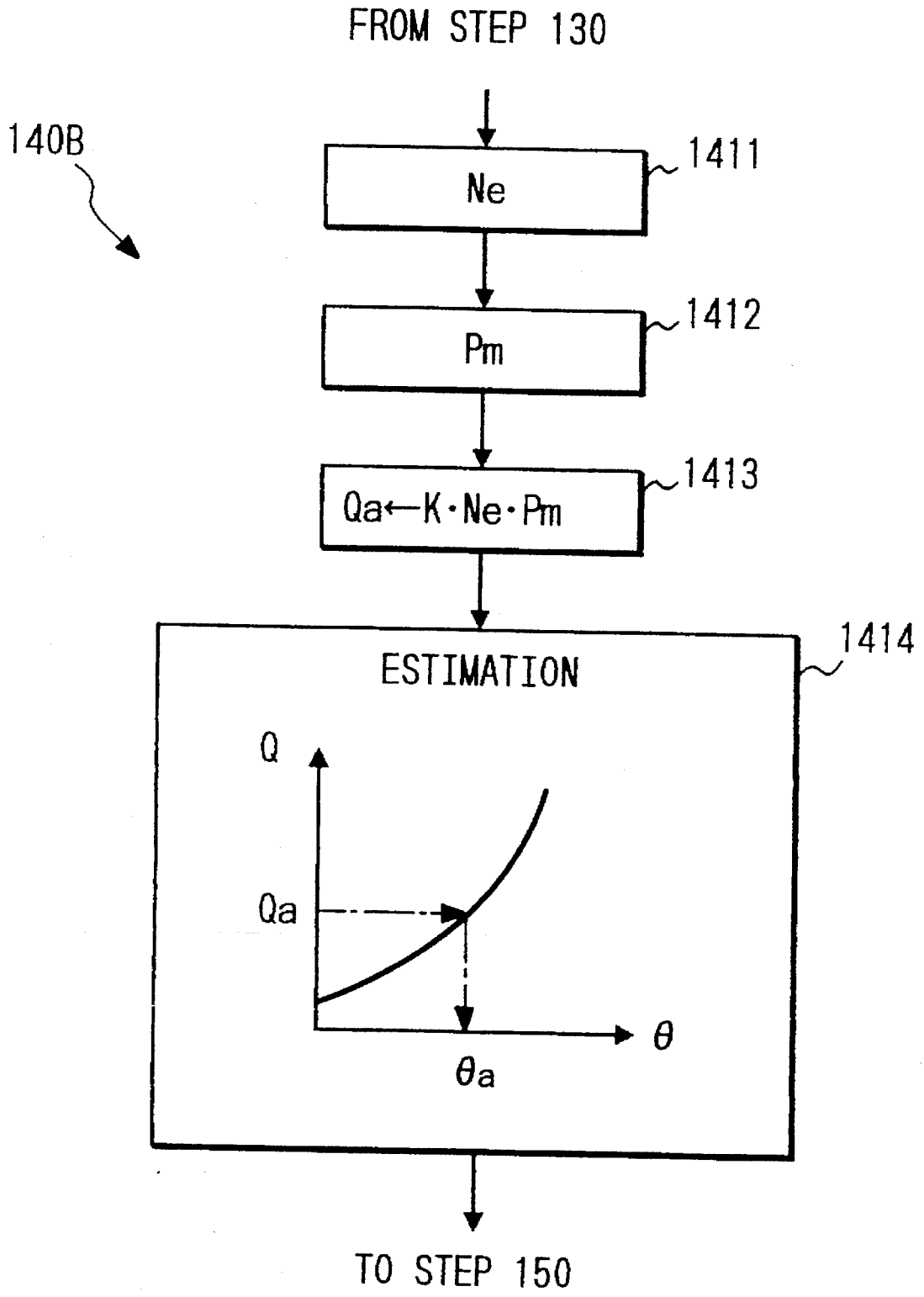
FIG. 18 is a flowchart of details of a program block in a throttle control apparatus according to a fifth embodiment of this invention.

FIG. 18 shows details of the estimated-value calculating block 140B. As shown in FIG. 18, a first step 1411 of the block 140B which follows the step 130 of FIG. 7 derives the current engine speed Ne from the output signal of the engine speed sensor 10 (see FIG. 3). A step 1412 following the step 1411 derives the current air induction passage pressure Pm from the output signal of the pressure sensor 9 (see FIG. 3).

A step 1413 subsequent to the step 1412 calculates the current air flow rate Qa from the current engine speed Ne and the current air induction passage pressure Pm according to the following equation.

$$Qa=K\cdot Ne\cdot Pm$$

where K denotes a predetermined coefficient.

A step 1414 following the step 1413 calculates an estimated value θa of the throttle opening degree from the current air flow rate Qa by referring to a map which determines the relation between the air flow rate and the estimated throttle opening degree. Data representing the map is previously stored into the ROM 22 (see FIG. 3). After the step 1414, the program exits from the estimated-value calculating block 140B and advances to the step 150 of FIG. 7.

Since the air flow rate Qa is determined in accordance with the engine speed Ne and the air induction passage pressure Pm, this embodiment can be applied to a system which has no air flow meter.

DESCRIPTION OF THE SIXTH PREFERRED EMBODIMENT

Figure 19:
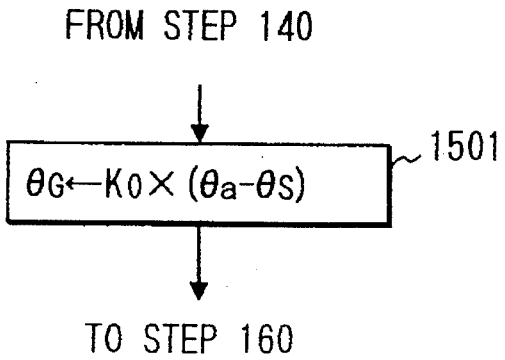
FIG. 19 is a diagram of a program step in a throttle control apparatus according to a sixth embodiment of this invention.

A sixth embodiment of this invention is similar to the embodiment of FIGS. 3–16 except for a design change indicated hereinafter. The sixth embodiment includes a step 1501 of FIG. 19 which replaces the step 150 of FIG. 7. The step 1501 subtracts the detected value θs of the throttle opening degree from the estimated value θa of the throttle opening degree, and multiplies the resultant of the subtraction by a predetermined gain Ko. Then, the step 1501 sets the corrective value θG equal to the resultant of the multiplication.

It should be noted that the corrective value θG may be incremented and decremented by a half of the difference between the estimated value θa and the detected value θs to execute the updating thereof.

DESCRIPTION OF THE SEVENTH PREFERRED EMBODIMENT

A seventh embodiment of this invention is similar to the embodiment of FIGS. 3–16 except for design changes indicated hereinafter. The seventh embodiment includes a block 150A which replaces the step 150 of FIG. 7.

Figure 20:
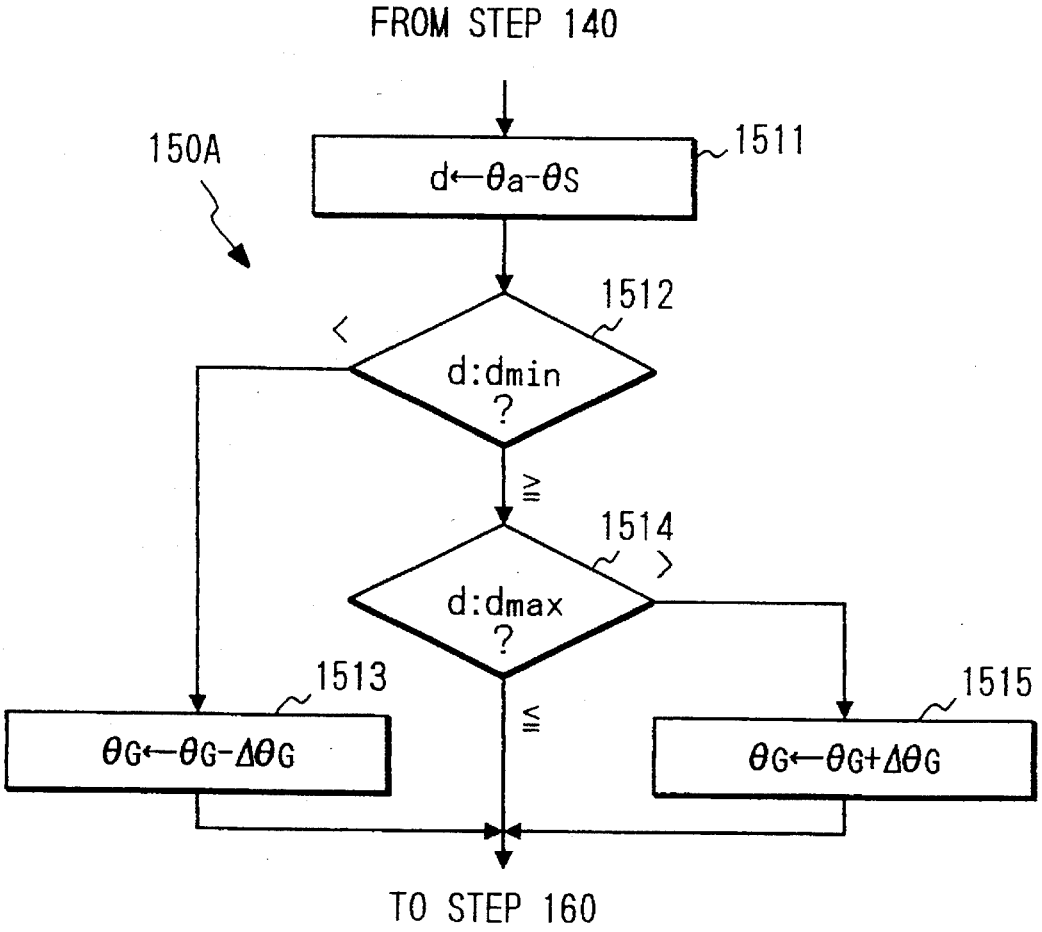
FIG. 20 is a flowchart of details of a program block in a throttle control apparatus according to a seventh embodiment of this invention.

FIG. 20 shows details of the block 150A. As shown in FIG. 20, a first step 1511 of the block 150A which follows the step 140 of FIG. 7 calculates a difference "d" which equals the estimated value θa of the throttle opening degree minus the detected value θs of the throttle opening degree. A step 1512 following the step 1511 compares the difference "d" with a predetermined lower limit value dmin. When the difference "d" is smaller than the lower limit value dmin, the program advances from the step 1512 to a step 1513 which decrements the corrective value θG by a predetermined value ΔθG. Otherwise, the program advances from the step 1512 to a step 1514. The step 1514 compares the difference "d" with a predetermined upper limit value dmax. When the difference "d" is greater than the upper limit value dmax, the program advances from the step 1514 to a step 1515 which increments the corrective value ΔθG by the predetermined value AθG. Otherwise, the program advances from the step 1514 and exits from the block 150A before proceeding to the step 160 of FIG. 7. In addition, after the steps 1513 and 1515, the program exits from the block 150A and proceeds to the step 160 of FIG. 7.

DESCRIPTION OF THE EIGHTH PREFERRED EMBODIMENT

Figure 21:
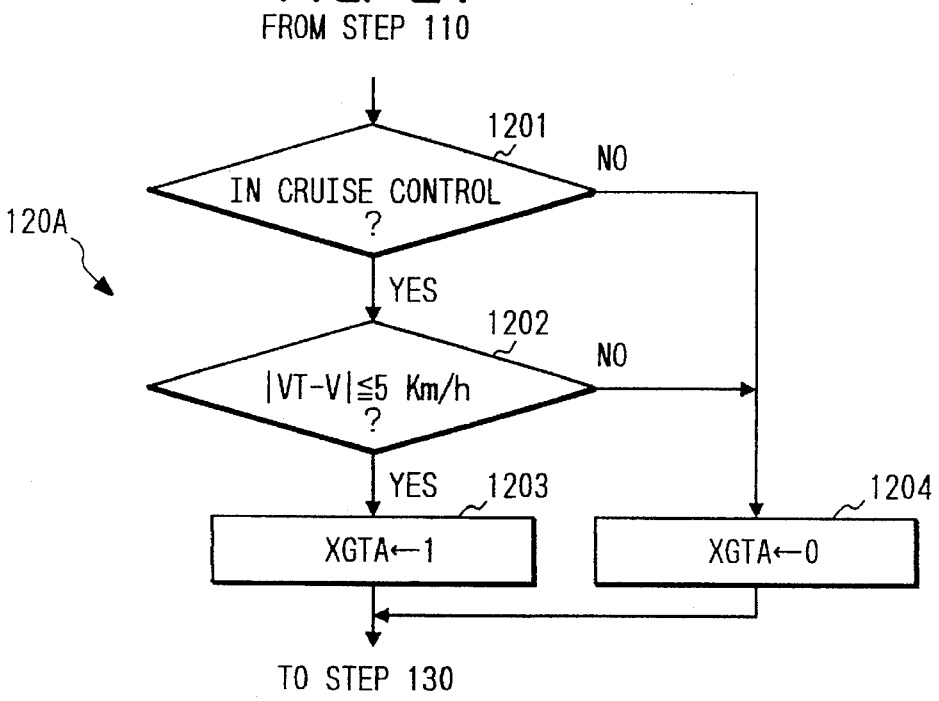
FIG. 21 is a flowchart of details of a program block in a throttle control apparatus according to an eighth embodiment of this invention.
Figure 22:
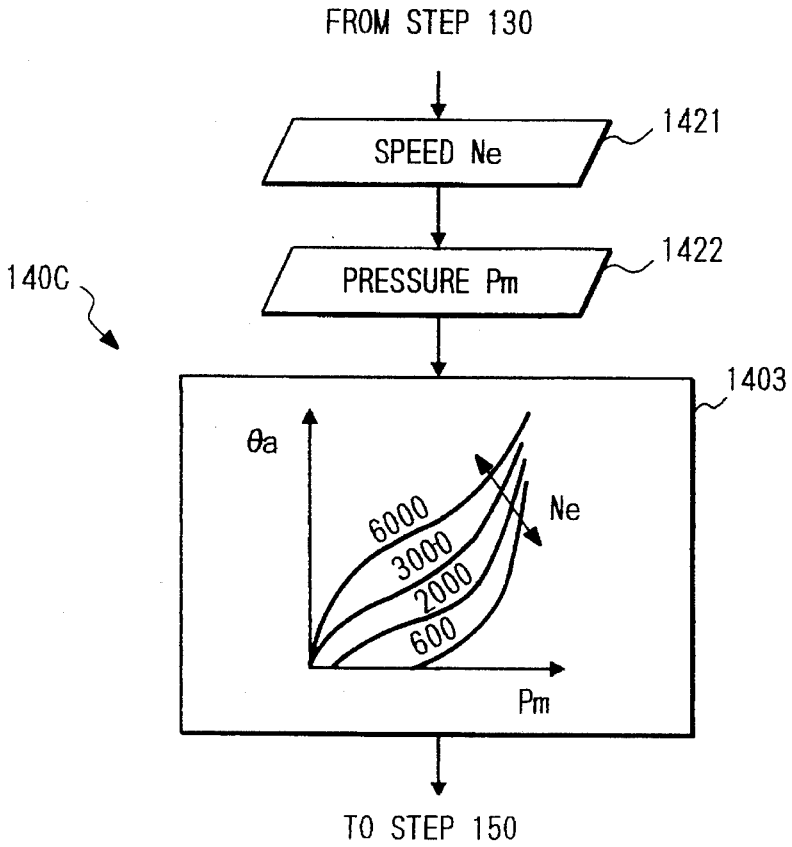
FIG. 22 is a flowchart of details of a program block in the throttle control apparatus according to the eighth embodiment.

An eighth embodiment of this invention is similar to the embodiment of FIGS. 3–16 except for design changes indicated hereinafter. The eighth embodiment includes an XGTA setting block 120A which replaces the XGTA setting block 120 of FIGS. 7 and 8. FIG. 21 shows details of the XGTA setting block 120A. In addition, the eighth embodiment includes an estimated-value calculating block 140C which replaces the estimated-value calculating block 140 of FIGS. 7 and 9. FIG. 22 shows details of the estimated-value calculating block 140C.

As shown in FIG. 21, a first step 1201 of the XGTA setting block 120A which follows the step 110 of FIG. 7 determines whether or not cruise control is currently executed. When the cruise control is currently executed, the program advances from the step 1201 to a step 1202. Otherwise, the program advances from the step 1201 to a step 1204. The step 1202 calculates the absolute value of the difference between the current vehicle speed V and a target vehicle speed VT. Then, the step 1202 compares the absolute value of the speed difference with a predetermined speed value of, for example, 5 km/h. When the absolute value of the speed difference is equal to or smaller than the predetermined speed value, the program advances from the step 1202 to a step 1203. Otherwise, the program advances from the step 1202 to the step 1204. The step 1203 sets the corrective value updating flag XGTA to "1". The step 1204 resets the corrective value updating flag XGTA to "0". After the steps 1203 and 1204, the program exits from the XGTA setting block 120A and proceeds to the step 130 of FIG. 7.

The steps 1201 and 1202 cooperate to determine whether or not the engine 1 is in given steady operating conditions. When the engine 1 is determined to be in the steady operating conditions, the corrective value updating flag XGTA is set to "1" by the step 1203.

As shown in FIG. 22, a first step 1421 of the estimated-value calculating block 140C which follows the step 130 of FIG. 7 derives the current engine speed Ne from the output signal of the engine speed sensor 10 (see FIG. 3). A step 1422 following the step 1421 derives the current air induction passage pressure Pm from the output signal of the pressure sensor 9 (see FIG. 3). A step 1423 following the step 1422 determines an estimated value θa of the throttle opening degree in accordance with the current engine speed Ne and the current air induction passage pressure Pm by referring to a map which determines the relation of the estimated throttle opening degree with the engine speed and the air induction passage pressure. Data representing the map is previously stored into the ROM 22 (see FIG. 3). After the step 1423, the program exits from the estimated-value calculating block 140C and advances to the step 150 of FIG. 7.

DESCRIPTION OF THE NINTH PREFERRED EMBODIMENT

Figure 23:
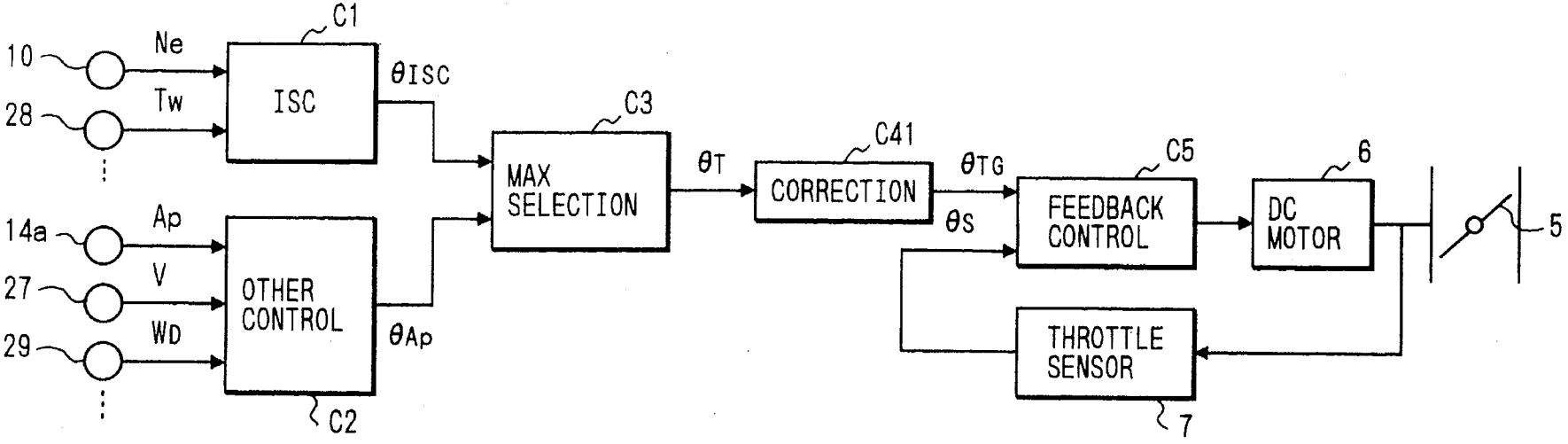
FIG. 23 is a diagram of a flow of operation of an electronic control unit in a throttle control apparatus according to a ninth embodiment of this invention.

FIG. 23 shows a ninth embodiment of this invention which is similar to the embodiment of FIGS. 3–16 except for design changes indicated hereinafter. The correcting block C4 (see FIG. 4) is omitted from the ninth embodiment. In the embodiment of FIG. 23, the throttle opening degree sensor 7 directly informs the feedback control block C5 of the detected value θs of the throttle opening degree.

The embodiment of FIG. 23 includes a correcting block C41 between the blocks C3 and C5. The block C41 corrects the target throttle opening degree θT into a final target throttle opening degree θTG in accordance with the corrective quantity θG. The correcting block C41 informs the feedback control block C5 of the final target throttle opening degree θTG. The block C5 executes feedback control in response to the final target throttle opening degree θTG and the detected throttle opening degree θs.

In this embodiment, the step 510 of FIG. 12 is modified to calculate the final throttle opening degree θTG which equals the detected throttle opening degree θs minus the corrective quantity θG.

DESCRIPTION OF THE OTHER PREFERRED EMBODIMENTS

In a first other embodiment of this invention, the corrective value updating flag XGTA is not set to "1" in response to normality of idle speed control (ISC). In the first other embodiment, to determine whether or not the engine 1 (see FIG. 3) is in predetermined steady operating conditions, a detection is made as to whether or not a variation of the engine speed Ne is in a given range. When the variation in the engine speed Ne is in the given range, that is, when the engine 1 is in the steady operating conditions, the corrective value updating flag XGTA is set to "1".

The previously-mentioned embodiments adjust the throttle valve 5 (see FIG. 3) in slightly open states to execute ISC. On the other hand, in a second other embodiment of this invention, an ISC valve disposed in a passage bypassing the throttle valve 5 is adjusted to execute ISC.

While the detected value derived from the output signal of the throttle opening degree sensor 7 (see FIG. 3) is used for control of the throttle valve 5 in the previously-mentioned embodiments, the detected value is used for control of an automatic transmission of the vehicle in a third other embodiment of this invention.

In a fourth other embodiment of this invention, the detected value of the throttle fully-closed position which is derived from the output signal of the throttle opening degree sensor 7 (see FIG. 3) is suitably updated in a known way. While the ISC learning process is allowed after the updating of the corrective value θG in the previously-mentioned embodiments, the ISC learning process is allowed after the updating of the detected value of the throttle fully-closed position in the fourth other embodiment.

What is claimed is:

1. A throttle control apparatus for controlling a degree of opening of a throttle valve via an actuator, the throttle valve being provided in an air induction passage of an internal combustion engine, the apparatus comprising:

a throttle opening degree sensor for detecting the degree of opening of the throttle valve;

engine speed detecting means for detecting a rotational speed of the engine;

throttle opening degree estimating means for estimating the degree of opening of the throttle valve on the basis of the rotational speed of the engine which is detected by the engine speed detecting means;

memorizing means for memorizing a corrective quantity;

corrective quantity updating means for updating the corrective quantity memorized by the memorizing means on the basis of a difference between an output value from the throttle opening degree sensor and an estimated value from the throttle opening degree estimating means; and control means for adjusting a controlled quantity of the actuator in response to the output value from the throttle opening degree sensor and the corrective quantity memorized by the memorizing means to control the degree of opening of the throttle valve.

2. The throttle control apparatus of claim 1, wherein the updating means comprises judging means for judging whether or not idle speed control of the engine is currently executed, and means for updating the corrective quantity when the judging means judges the idle speed control to be currently executed.

3. The throttle control apparatus of claim 1, further comprising engine load detecting means for detecting a load on the engine, and wherein the throttle opening degree estimating means comprises means for correcting the estimated value of the degree of opening of the throttle valve in response to the engine load detected by the engine load detecting means.

4. The throttle control apparatus of claim 1, wherein the control means comprises setting means for setting a target degree of opening of the throttle valve, correcting means for correcting the output value from the throttle opening degree sensor in accordance with the corrective quantity, and means for feedback-controlling the actuator in response to the target degree of opening of the throttle valve and a value which results from said correcting by the correcting means.

5. The throttle control apparatus of claim 1, wherein the control means comprises setting means for setting a target degree of opening of the throttle valve, correcting means for correcting the target degree of opening of the throttle valve in accordance with the corrective quantity, and means for feedback-controlling the actuator in response to the output value from the throttle opening degree sensor and a value which results from said correcting by the correcting means.

6. The throttle control apparatus of claim 1, further comprising:

idle control means for, in cases where the engine is in a predetermined idling condition, adjusting a rate of air flow into the engine to feedback-control a speed of the engine at a predetermined idle speed;

learning means for, after the corrective quantity is updated by the corrective quantity updating means, updating and memorizing an idle control learned quantity on the basis of a feedback control quantity by the idle control means; and adjusting means for, in cases where the engine is in the predetermined idling condition, adjusting the rate of air flow into the engine in accordance with the idle control learned quantity updated and memorized by the learning means.

7. An apparatus for setting a reference degree of opening of a throttle valve provided in an air induction passage of an internal combustion engine, the apparatus comprising:

a throttle opening degree sensor for detecting the degree of opening of the throttle valve;

engine speed detecting means for detecting a rotational speed of the engine;

throttle opening degree estimating means for estimating the degree of opening of the throttle valve on the basis of the rotational speed of the engine which is detected by the engine speed detecting means;

memorizing means for memorizing a corrective quantity;

corrective quantity updating means for updating the corrective quantity memorized by the memorizing means on the basis of a difference between an output value from the throttle opening degree sensor and an estimated value from the throttle opening degree estimating means; and correcting means for correcting the reference degree of opening of the throttle valve in accordance with the corrective quantity memorized by the memorizing means.

8. The throttle control apparatus of claim 7, wherein the updating means comprises judging means for judging whether or not idle speed control of the engine is currently executed, and means for updating the corrective quantity when the judging means judges the idle speed control to be currently executed.

9. A throttle control apparatus for controlling a degree of opening of a throttle valve via an actuator, the throttle valve being provided in an air induction passage of an internal combustion engine, the apparatus comprising:

a throttle opening degree sensor for detecting the degree of opening of the throttle valve;

corrective quantity learning means for detecting a corrective quantity for an output value from the throttle opening degree sensor on the basis of the output value from the throttle opening degree sensor and/or a predetermined parameter related to a rotational speed of the engine, and for updating and memorizing the corrective quantity;

ISC means for adjusting a controlled quantity of the actuator in response to the output value from the throttle opening degree sensor, the corrective quantity updated by the corrective quantity learning means, and an ISC learned value to adjust the degree of opening of the throttle valve, and for calculating a feedback control quantity to make a speed of the engine equal to a target speed and further adjusting the controlled quantity of the actuator in response to the calculated feedback control quantity to adjust the degree of opening of the throttle valve;

allowing means for allowing an ISC learning process when the corrective quantity is updated by the corrective quantity learning means; and ISC learning means for executing a process of learning the ISC learned value on the basis of the feedback control quantity calculated by the ISC means when the allowing means allows the ISC learning process.

10. An apparatus for a movable throttle valve in an engine, comprising:

first means for detecting an actual position of the throttle valve and generating a throttle position signal representative thereof;

second means for detecting a rotational speed of the engine;

third means for estimating an effective position of the throttle valve in response to the engine rotational speed detected by the second means; and fourth means for correcting the throttle position signal in accordance with the effective throttle valve position estimated by the third means.

11. The apparatus of claim 10, further comprising fifth means for controlling the throttle valve in response to an output signal of the fourth means.

* * * * *